US009493004B2

(12) United States Patent
Ishibashi et al.

(10) Patent No.: US 9,493,004 B2
(45) Date of Patent: Nov. 15, 2016

(54) LIQUID DISCHARGE APPARATUS AND METHOD FOR CONTROLLING THE SAME

(71) Applicant: CANON KABUSHIKI KAISHA, Tokyo (JP)

(72) Inventors: Tohru Ishibashi, Kawasaki (JP); Yoshimasa Araki, Utsunomiya (JP); Akio Saito, Machida (JP); Koichi Kitakami, Tokyo (JP); Yasuyuki Tamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/539,344

(22) Filed: Nov. 12, 2014

(65) Prior Publication Data

US 2015/0144709 A1 May 28, 2015

(30) Foreign Application Priority Data

Nov. 22, 2013 (JP) ..... 2013-241625
Oct. 14, 2014 (JP) ..... 2014-210225

(51) Int. Cl.
*B41J 2/165* (2006.01)

(52) U.S. Cl.
CPC ..... *B41J 2/16532* (2013.01); *B41J 2/16535* (2013.01); *B41J 2002/16555* (2013.01)

(58) Field of Classification Search
CPC B41J 2/16505; B41J 2/1652; B41J 2/16523; B41J 2/1707; B41J 2/1714; B41J 2002/16555
USPC ..... 347/84–86
See application file for complete search history.

(56) References Cited

U.S. PATENT DOCUMENTS

| | | | | |
|---|---|---|---|---|
| 5,508,722 | A | 4/1996 | Saito et al. | |
| 6,048,046 | A | 4/2000 | Saito et al. | |
| 6,312,086 | B1 | 11/2001 | Saito et al. | |
| 6,467,868 | B1 | 10/2002 | Saito et al. | |
| 7,971,959 | B2 | 7/2011 | Brown et al. | |
| 8,210,641 | B2 * | 7/2012 | Eguchi | B41J 2/14024 347/22 |
| 2008/0049066 | A1 * | 2/2008 | Inoue | B41J 2/16538 347/33 |
| 2010/0245463 | A1 | 9/2010 | Maida | |
| 2011/0205296 | A1 | 8/2011 | Colombat et al. | |
| 2011/0279525 | A1 * | 11/2011 | Suzuki | B41J 2/16585 347/30 |
| 2011/0285782 | A1 | 11/2011 | Kim et al. | |

FOREIGN PATENT DOCUMENTS

| | | | |
|---|---|---|---|
| CN | 102196916 | A | 9/2011 |
| CN | 102248795 | A | 11/2011 |

(Continued)

OTHER PUBLICATIONS

Office Action dated Jan. 13, 2016, in corresponding Chinese Patent Application No. 201410675337.2.

*Primary Examiner* — Julian Huffman
*Assistant Examiner* — Sharon A Polk
(74) *Attorney, Agent, or Firm* — Fitzpatrick, Cella, Harper & Scinto

(57) ABSTRACT

A liquid discharge apparatus comprises a head having a discharge port surface on which a discharge port is provided for discharging a liquid, and a liquid moving unit arranged apart from the discharge port surface and configured to be movable along the discharge port surface, wherein, the liquid moving unit moves a liquid on the discharge port surface to a collection position in which the discharge port is not provided, with a moving of the liquid moving unit.

30 Claims, 25 Drawing Sheets

(56) References Cited

FOREIGN PATENT DOCUMENTS

| | | | | |
|---|---|---|---|---|
| JP | 05-77437 | A | | 3/1993 |
| JP | H05201028 | | * | 8/1993 |
| JP | 2006-289809 | A | | 10/2006 |
| JP | 2009-160868 | A | | 7/2009 |
| JP | 2010-105164 | A | | 5/2010 |
| JP | 2010-228096 | A | | 10/2010 |
| JP | 2010-274533 | A | | 12/2010 |
| JP | 2012-106448 | A | | 6/2012 |
| JP | 2013-31962 | A | | 2/2013 |

* cited by examiner

LIQUID DISCHARGE APPARATUS AND METHOD FOR CONTROLLING THE SAME

BACKGROUND OF THE INVENTION

Field of the Invention

The present invention relates to a liquid discharge apparatus which discharges a liquid from its head, and to a method for controlling the same.

Description of the Related Art

As one of printing methods, there is an ink jet method which discharges a liquid droplet (ink droplet) from a recording head and draws an image. In recent years, an ink jet type of a liquid discharge apparatus is used in various fields, for instance, in the manufacture of semiconductor devices and the like. Here, when a foreign substance adheres on an object to be drawn (for instance, a semiconductor wafer) onto which a droplet is discharged, the foreign substance occasionally causes a defect in a product and the like.

In the ink jet type of the liquid discharge apparatus, a droplet and/or a foreign substance such as paper powder in the apparatus occasionally adhere on a discharge port surface in the vicinity of a discharge port of a recording head. When the droplet and/or the foreign substance which have adhered on the discharge port surface have been left, the left droplet and/or foreign substance are dried and occasionally stick to the discharge port surface. When the droplet and/or the foreign substance have stuck to the vicinity of the discharge port, discharge characteristics such as a quantity of the droplet to be discharged from the discharge port, a discharge direction of the droplet and a discharge speed of the droplet change, and density unevenness and streaks are occasionally formed due to the disarray of dots on the object to be drawn. In addition, this sticking substance (foreign substance) also occasionally drops onto and results in adhering on the object to be drawn.

There is a technology of sweeping (wiping) the discharge port surface with a wiper, as a technology of removing the droplet and/or the foreign substance which have adhered on the discharge port surface. However, in this technology, the discharge port surface is mechanically wiped, and accordingly wear and peeling occasionally occur on a member on the discharge port surface.

Then, Japanese Patent Application Laid-Open No. H05-077437 discloses a technology of blowing air onto the discharge port surface, and thereby blowing off and removing the droplet and/or the foreign substance which have adhered on the discharge port surface. According to this technology, no wiper needs to mechanically come in contact with the discharge port surface, and accordingly the wear and the peeling of the member on the discharge port surface do not occur, but the deposited substance which has adhered on the discharge port surface can be removed.

When the droplet and/or the foreign substance which have adhered on the discharge port surface are blown by blowing air, the blown droplet and/or foreign substance occasionally result in adhering on the discharge port surface again.

In the technology disclosed in Japanese Patent Application Laid-Open No. H05-077437, a positional relationship between an injection orifice of air and the discharge port surface is fixed, and the position on the discharge port surface to which air is blown shall be fixed. Because of this, even when the blown droplet and/or foreign substance have adhered on the discharge port surface again, air is not blown to the place, and it is difficult to blow the droplet and/or foreign substance again which have adhered again. In addition, in some places, the droplet and/or the foreign substance occasionally are not sufficiently removed even though the air is blown thereto.

For this reason, in the technology for removing the droplet and/or the foreign substance by blowing air, which is disclosed in Japanese Patent Application Laid-Open No. H05-077437, there are such problems that unevenness occurs in a region on the discharge port surface, from which the deposited substance such as the droplet and the foreign substance can be removed, and the deposited substance has a possibility of resulting in remaining in the vicinity of the discharge port.

SUMMARY OF THE INVENTION

An object of the present invention is to provide a liquid discharge apparatus which can reduce such a possibility that a deposited substance remains in the vicinity of a discharge port, and to provide a method for controlling the same.

A liquid discharge apparatus of the present invention includes: a head having a discharge port surface on which a discharge port is provided for discharging a liquid; and a liquid moving unit arranged apart from the discharge port surface and configured to be movable along the discharge port surface, wherein, the liquid moving unit moves a liquid on the discharge port surface to a collection position in which the discharge port is not provided, with a moving of the liquid moving unit.

A method for controlling a liquid discharge apparatus provided with a head having a discharge port surface on which a discharge port is provided for discharging a liquid, comprising: moving a liquid on the discharge port surface to a collection position in which the discharge port is not provided, by a liquid moving unit that is arranged apart from the discharge port surface and configured to be movable along the discharge port surface.

Further features of the present invention will become apparent from the following description of exemplary embodiments with reference to the attached drawings.

BRIEF DESCRIPTION OF THE DRAWINGS

FIG. 1A is a cross-sectional view illustrating one example of a configuration of a liquid discharge apparatus of the first embodiment in the present invention; FIG. 1B is a view of a recording head illustrated in FIG. 1A, which is viewed from a discharge port surface side; and FIG. 1C is a view of a suction port illustrated in FIG. 1A, which is viewed from a recording head side.

FIG. 19B is a view illustrating a state in which the liquid-collection body illustrated in FIG. 19A has collected the liquid; and FIG. 19C is a view illustrating another example of the configuration of the liquid-collection body illustrated in FIG. 18.

FIG. 22A is a cross-sectional view illustrating a configuration of a liquid discharge apparatus of the tenth embodiment.

FIG. 22B is a view of a discharge port surface which is viewed from the direction of the arrow A illustrated in FIG. 22A.

FIG. 22C is a view of the end of the suction port, which is viewed from the direction of the arrow B illustrated in FIG. 22A.

DESCRIPTION OF THE EMBODIMENTS

Figure 1A:
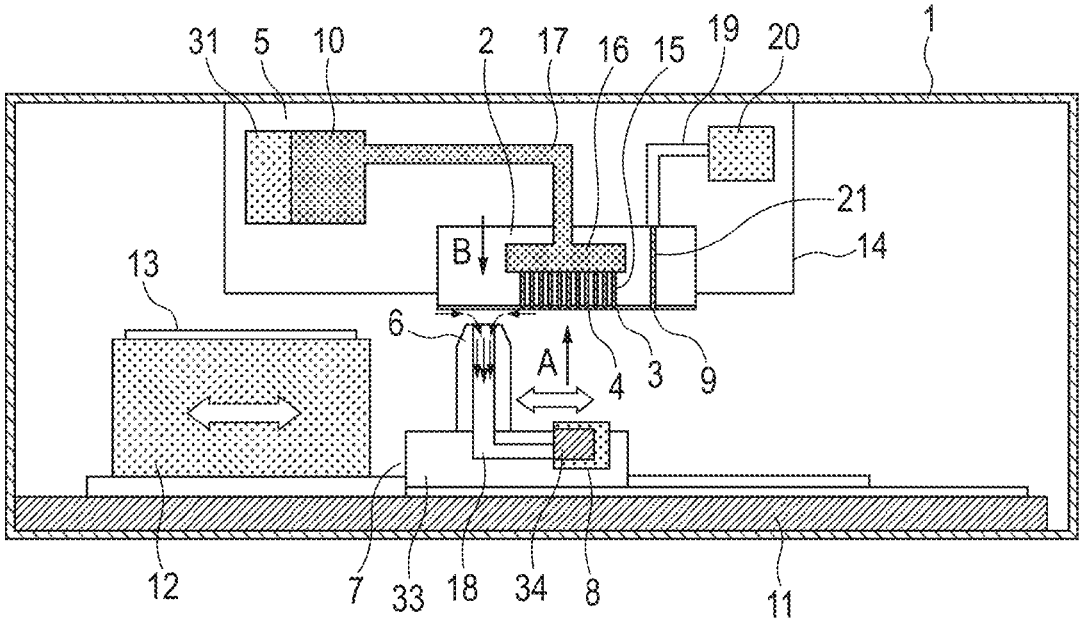
FIGS. 1A, 1B and 1C are views for describing a first embodiment in the present invention.

Preferred embodiments of the present invention will now be described in detail in accordance with the accompanying drawings.

The mode for carrying out the present invention will be described below with reference to the drawings. In each of the drawings, the same reference numerals will be used for the same structures, and overlapping descriptions will be omitted.

First Embodiment

FIG. 1A is a cross-sectional view illustrating a configuration of a liquid discharge apparatus 1 of a first embodiment in the present invention.

In the liquid discharge apparatus 1, a base plate 11 is installed. On the base plate 11, a drawn-object transportation section 12 is mounted. The drawn-object transportation section 12 sucks an object 13 to be drawn with an unillustrated suction unit, and holds the sucked object thereon. In addition, the drawn-object transportation section 12 can move in a horizontal direction (left-right direction) with respect to the base plate 11 in FIG. 1A.

In the liquid discharge apparatus 1, a recording head mounting section 14 is provided. On the recording head mounting section 14, a recording head 2 which discharges a liquid is mounted. The recording head 2 and the recording head mounting section 14 are electrically connected to each other by an unillustrated connecting portion. In addition, the recording head mounting section 14 is also electrically connected to an unillustrated control system of the liquid discharge apparatus 1 by an unillustrated connecting portion.

On one surface of the recording head 2, a discharge port 3 which discharges a liquid is provided. The surface on which the discharge port 3 is provided is hereafter referred to as a discharge port surface 4. The discharge port 3 communicates with an individual liquid chamber 15. The individual liquid chamber 15 communicates with a common liquid chamber 16, and the common liquid chamber 16 communicates with a supply flow path 17. The supply flow path 17 communicates with a supply unit 5.

The supply unit 5 has a liquid tank 10 and a pressure control section 31. Although not shown in the Figures, the pressure control section 31 has a pump, a regulator and a pressure-detecting portion. The pressure control section 31 operates the pump which the pressure control section 31 has, and controls a pressure which is generated by the pump, with the regulator and the pressure-detecting portion. Thereby, the meniscus in the discharge port 3 can be kept.

A discharge signal is transmitted to the recording head 2, and thereby a liquid in the individual liquid chamber 15 is discharged from the discharge port 3 as a droplet. The liquid to be discharged includes a liquid containing an electroconductive material for a wiring pattern, an ultraviolet-ray (UV) curable liquid for industrial use and image recording, and a liquid (ink) formed of a solvent and a coloring material for image recording.

A liquid collection port 9 is provided in a position on the discharge port surface 4, in which the discharge port 3 is not provided. The liquid collection port 9 communicates with a liquid collecting flow path 21. The liquid collecting flow path 21 communicates with a flow channel 19 connected to a liquid-collection unit. The flow channel 19 connected to the liquid-collection unit communicates with the liquid-collection unit 20 which functions as a liquid-collection unit.

Although not shown in the Figures, the liquid-collection unit 20 has a pump, a regulator and a pressure-detecting portion. The liquid-collection unit 20 operates the pump which the liquid-collection unit 20 has, and controls a pressure which is generated by the pump, with the regulator and the pressure-detecting portion. Thereby, a suction pressure to be generated in the liquid collection port 9 can be controlled.

On the base plate 11, a liquid moving unit 7 which moves a liquid on the discharge port surface 4 is mounted.

The liquid moving unit 7 moves the liquid on the discharge port surface 4 to a predetermined position (collection position). The liquid moving unit 7 has a suction port 6 and a moving section 33.

Figure 1B:
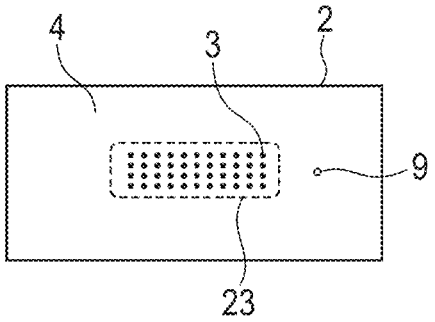
Figure 1C:
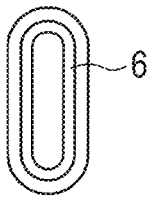

The moving section 33 is configured so as to be movable in the horizontal direction (left-right direction) in FIGS. 1A to 1C. The liquid moving unit 7 is configured to be movable along the discharge port surface 4 by the movement of the moving section 33. The suction port 6 is provided on the moving section 33, and the suction port 6 also moves according to the movement of the moving section 33.

The suction port 6 is separated from the discharge port surface 4, and is provided so as to be movable along the discharge port surface 4 according to the movement of the moving section 33. The suction port 6 communicates with a suction flow channel 18, and the suction flow channel 18 communicates with a controlling unit 8.

The controlling unit 8 has a negative-pressure generation mechanism 34 which functions as a negative pressure generating unit. Although not shown in the Figures, the negative-pressure generation mechanism 34 has a pump, a regulator and a pressure-detecting portion. The negative-pressure generation mechanism 34 operates the pump which the negative-pressure generation mechanism 34 has, and controls a pressure which is generated by the pump, with the regulator and the pressure-detecting portion. Thereby, a suction pressure which is generated in the suction port 6 can be controlled. In addition, the controlling unit 8 controls the movement of the moving section 33.

FIG. 1B is a view of the discharge port surface 4 which is viewed from the direction shown by the arrow A illustrated in FIG. 1A.

On the discharge port surface 4, the discharge port 3 and the liquid collection port 9 are provided. The liquid collection port 9 is provided in a position that deviates from the region (hereinafter referred to as discharge port array region 23) in which the discharge port 3 is provided. However, when a distance between the discharge ports 3 is large, the liquid collection port 9 may be provided between the discharge ports 3.

FIG. 1C is a view of the suction port 6 which is viewed from the direction shown by the arrow B illustrated in FIG. 1A.

The suction port 6 has an oval shape. However, the shape of the suction port 6 is not limited to the oval shape, and may be a shape such as an elliptical shape, a circle, a square and a rectangle.

Figure 2:
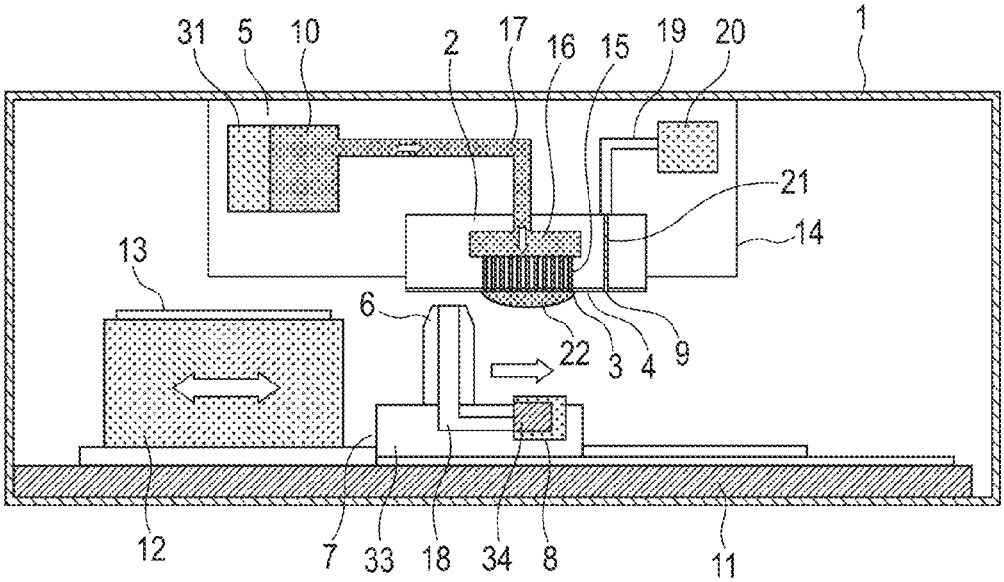
FIG. 2 is a view illustrating a state in which a liquid has been supplied to the recording head of the liquid discharge apparatus illustrated in FIGS. 1A to 1C.

FIG. 2 is a view illustrating a state in which a liquid has been supplied to the recording head 2.

The pressure control section 31 in the supply unit 5 controls a pressure which is generated by the pump that the pressure control section 31 has, and thereby a liquid in the liquid tank 10 is supplied up to the surface of the discharge port surface 4.

The pressure control section 31 applies a positive pressure of +20 kPa, for instance, which functions as a first pressurizing (positive pressure) pressure, to a liquid in the liquid tank 10, as a gage pressure (difference between absolute pressure and atmospheric pressure). As a result, the liquid in the liquid tank 10 is supplied from the discharge port 3 up to the surface of the discharge port surface 4.

When the foreign substance adheres on the discharge port surface 4, if the liquid 22 on the discharge port surface 4 intrudes into the inside of the discharge port 3 and is discharged from the discharge port 3 onto the object 13 to be drawn, the foreign substance which has adhered on the discharge port surface 4 also occasionally results in adhering on the object 13 to be drawn.

For this reason, after having supplied a liquid to the recording head 2, the pressure control section 31 applies a pressurizing pressure of +1 kPa, which functions as a second pressurizing pressure having an absolute value smaller than that of the first pressurizing pressure, to the liquid in the liquid tank 10. By doing so, the pressure control section 31 can prevent the liquid 22 on the discharge port surface 4 from intruding into the inside of the discharge port 3. However, the pressure to be applied to the liquid in the liquid tank 10, when the liquid is supplied to the recording head 2 and after the liquid has been supplied thereto, is not limited to the above described numeric value.

Next, the movement of the liquid 22 on the discharge port surface 4 by the liquid moving unit 7 will be described below with reference to FIG. 3A to FIG. 3C.

Figure 3A:
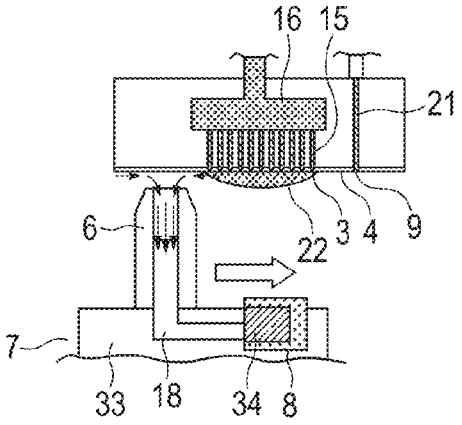
FIGS. 3A, 3B and 3C are views for describing the movement of a liquid on a discharge port surface, by a liquid moving unit illustrated in FIG. 1A.

FIG. 3A is a view illustrating a state in which the liquid has been supplied up to the surface of the discharge port surface 4 by the supply unit 5. Incidentally, after the liquid has been supplied to the discharge port surface 4, a pressurizing pressure of +1 kPa is added to the liquid in the liquid tank 10, and accordingly the liquid 22 on the discharge port surface 4 does not intrude into the inside of the discharge port 3.

The discharge port surface 4 and the suction port 6 are separated from each other. A distance between the discharge port surface 4 and the suction port 6 is 1 mm, for instance. However, the distance between the discharge port surface 4 and the suction port 6 is not limited to the above described numeric value.

Here, a pressure in the inner part of the suction port 6 is controlled, for instance, to −1 kPa by the negative-pressure generation mechanism 34 in the controlling unit 8. However, the pressure in the inner part of the suction port 6 is not limited to the above described numeric value.

In FIG. 3A, the suction port 6 is in a position that is distant from a region in which the discharge port 3 is provided.

The controlling unit 8 moves the moving section 33 to the direction (right direction) shown by the open arrow, and thereby moves the suction port 6 relatively along the discharge port surface 4.

Figure 3B:
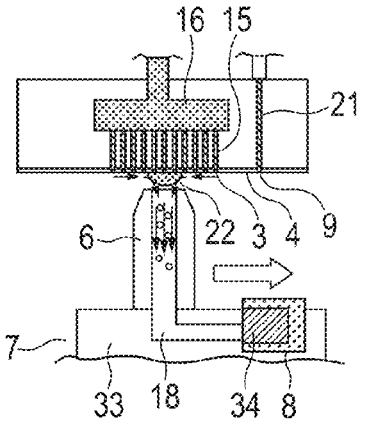
Figure 3C:
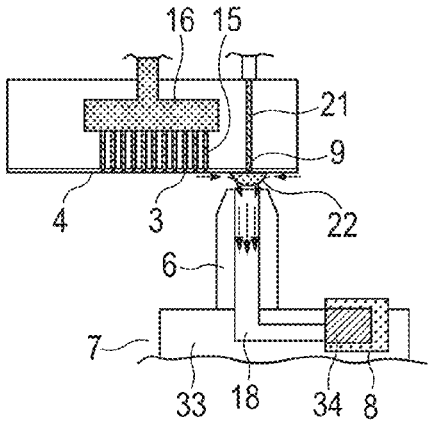

FIG. 3B is a view illustrating a state in which the suction port 6 has been moved to a right direction from a position illustrated in FIG. 3A.

The pressure in the inside of the suction port 6 is controlled to −1 kPa, and accordingly a part of the liquid 22 on the discharge port surface 4 is sucked from the suction port 6 and is collected in an unillustrated liquid-storing portion in the controlling unit 8 through the suction flow channel 18. In addition, a part of the liquid 22 on the discharge port surface 4 moves to the vicinity of the position on the discharge port surface 4, which faces the suction port 6, while being held on the discharge port surface 4 by the suction from the suction port 6.

Thus, the pressure in the inner part of the suction port 6 is controlled to an appropriate pressure, and thereby the liquid 22 on the discharge port surface 4 can be moved on the discharge port surface 4 according to the moving of the suction port 6.

The controlling unit 8 moves the liquid 22 on the discharge port surface 4 to a collection position which is the vicinity of the liquid collection port 9 in the present embodiment. Specifically, the controlling unit 8 further moves the moving section 33 to the direction (right direction) shown by the open arrow, and moves the suction port 6 to the position facing the liquid collection port 9, as is illustrated in FIG. 3C.

When having moved the suction port 6 to the position facing the liquid collection port 9, the controlling unit 8 stops the movement of the moving section 33. As has been described above, the liquid 22 on the discharge port surface 4 moves to the vicinity of the position facing the suction port 6, by the suction from the suction port 6. Because of this, the liquid 22 on the discharge port surface 4 also moves to the vicinity of the liquid collection port 9 which is the collection position.

After the liquid 22 on the discharge port surface 4 has been moved to the collection position in which the discharge port 3 is not provided, a negative pressure of −2 kPa, for instance, is applied to the liquid in the liquid tank 10, by the pressure control section 31 in the supply unit 5. By doing so, the liquid does not drip from the discharge port 3, is held there, and is set at a state in which the liquid can be discharged from the discharge port 3.

The liquid 22 which has moved to the vicinity of the liquid collection port 9 is collected from the liquid collection port 9.

Figure 4:
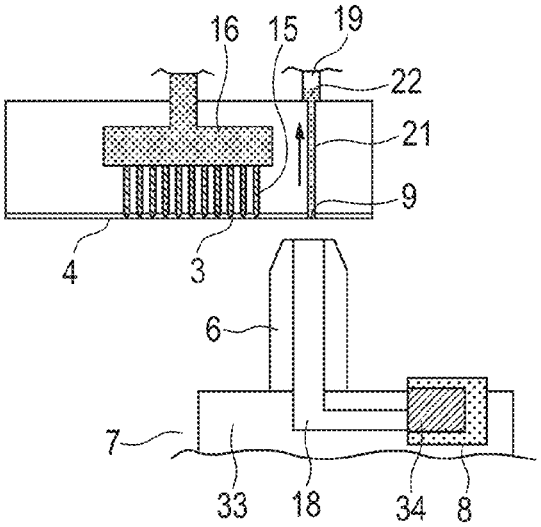
FIG. 4 is a view for describing an operation of collecting a liquid by a liquid-collection unit illustrated in FIG. 1A.

FIG. 4 is a view illustrating a state in which the liquid 22 in the vicinity of the liquid collection port 9 is collected from the liquid collection port 9.

When having moved the suction port 6 to the position facing the liquid collection port 9, the controlling unit 8 stops the pump of the negative-pressure generation mechanism 34. When the pump of the negative-pressure generation mechanism 34 is stopped, the suction from the suction port 6 thereby stops.

Next, the pump in the liquid-collection unit 20 is operated, and the suction pressure is generated in the liquid collection port 9. The pressure in the inner part of the liquid collection port 9 is controlled, for instance, to −20 kPa. However, the pressure in the inner part of the liquid collection port 9 is not limited to the above described numeric value.

When the suction pressure is generated in the liquid collection port 9, the liquid in the vicinity of the liquid collection port 9 is thereby collected in the liquid-collection portion which is provided in the liquid-collection unit 20, through the liquid collecting flow path 21 and the flow channel 19 connected to the liquid-collection unit. Thus, the pressure in the inner part of the liquid collection port 9 is controlled to an appropriate pressure, and thereby the liquid 22 in the vicinity of the liquid collection port 9 can be collected from the liquid collection port 9.

Thus, the liquid discharge apparatus 1 of the present embodiment is provided with the suction port 6 which is separated from and faces the discharge port surface 4, and has the liquid moving unit 7 which is configured to be movable along the discharge port surface 4. The liquid moving unit 7 moves the suction port 6 along the discharge port surface 4, and thereby moves the liquid 22 on the discharge port surface 4 to the position in which the discharge port 3 is not provided, by the suction from the suction port 6.

The liquid 22 on the discharge port surface 4 is moved to the position in which the discharge port 3 is not provided, by the suction from the suction port 6 that the liquid moving unit 7 has, and accordingly the deposited substance such as the droplet and the foreign substance in the vicinity of the discharge port 3 is removed. In addition, the liquid moving unit 7 is configured to be movable along the discharge port surface 4, accordingly the occurrence of unevenness is suppressed in the region on the discharge port surface 4, from which the deposited substance is removed, and such a possibility can be lowered that the deposited substance remains in the vicinity of the discharge port 3.

Figure 5:
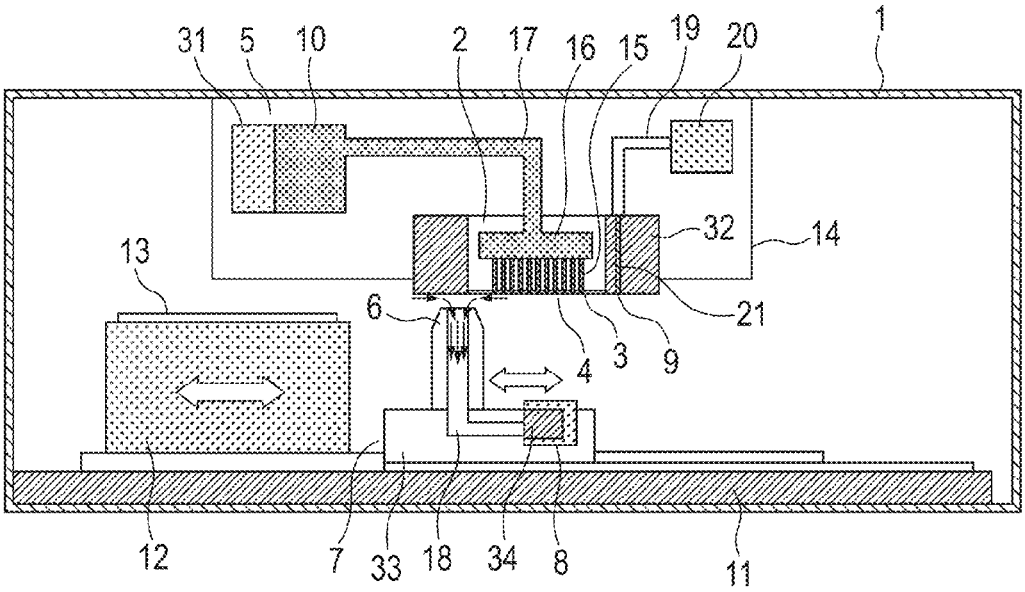
FIG. 5 is a cross-sectional view illustrating another example of the configuration of the liquid discharge apparatus of the first embodiment in the present invention.

Incidentally, in the liquid discharge apparatus, a head guide portion for guiding the recording head 2 is occasionally attached in the periphery of the recording head 2. FIG. 5 is a cross-sectional view illustrating a configuration of a liquid discharge apparatus 1 of the present embodiment, in the case where the head guide portion is provided.

As is illustrated in FIG. 5, the head guide portion 32 is provided in the periphery of the recording head 2 so that one surface thereof forms approximately the same plane as the discharge port surface 4. On one surface of the head guide portion 32, the liquid collection port 9 is provided. However, the liquid collection port 9 may be provided on a jointed portion between the recording head 2 and the head guide portion 32.

The liquid moving unit 7 is configured so that the suction port 6 can move along the discharge port surface 4 of the recording head 2 and one surface of the head guide portion 32. The liquid moving unit 7 moves the liquid 22 on the discharge port surface 4 to the vicinity of the liquid collection port 9 which is provided on one surface of the head guide portion 32 as the collection position.

As has been described above, the discharge port surface 4 and one surface of the head guide portion 32 on which the liquid collection port 9 is provided exist approximately on the same plane, and accordingly the liquid moving unit 7 can move the liquid 22 on the discharge port surface 4 to the vicinity of the liquid collection port 9 which is provided on one surface of the head guide portion 32.

Second Embodiment

Figure 6:
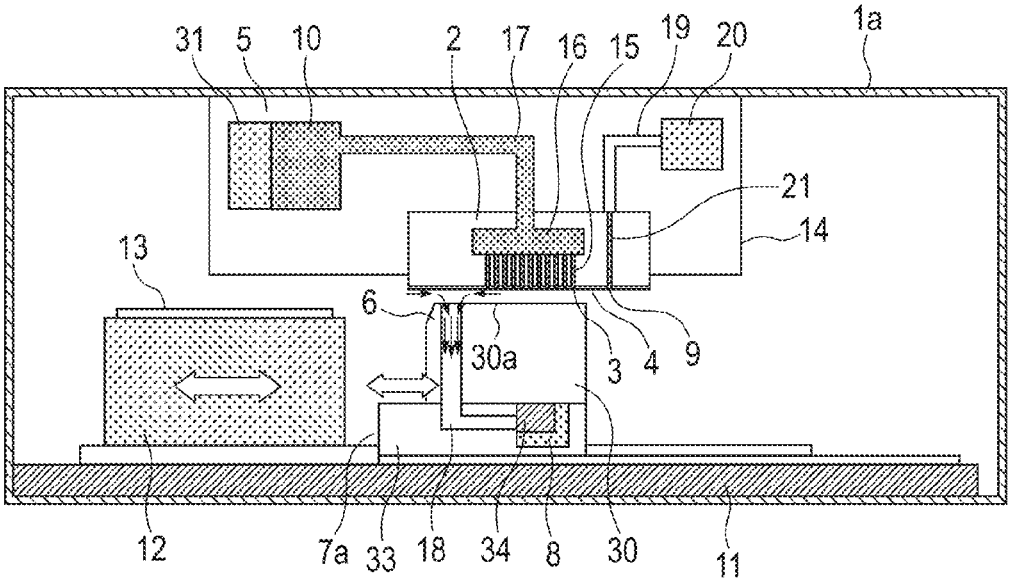
FIG. 6 is a cross-sectional view illustrating a configuration of a liquid discharge apparatus of a second embodiment in the present invention.

FIG. 6 is a cross-sectional view illustrating a configuration of a liquid discharge apparatus 1*a* of a second embodiment in the present invention.

The liquid discharge apparatus 1*a* of the present embodiment is different from the liquid discharge apparatus 1 of the first embodiment, in the point that the liquid moving unit 7 is changed to a liquid moving unit 7*a*.

The liquid moving unit 7*a* is different from the liquid moving unit 7, in the point that a liquid-holding portion 30 is added.

The liquid-holding portion 30 is mounted on the moving section 33 so that one surface 30*a* thereof is separated from and faces the discharge port surface 4. A distance between the discharge port surface 4 and the one surface 30*a* of the liquid-holding portion 30 is a distance at which the liquid 22 on the discharge port surface 4 comes in contact with the one surface 30*a* of the liquid-holding portion 30.

Figure 7:
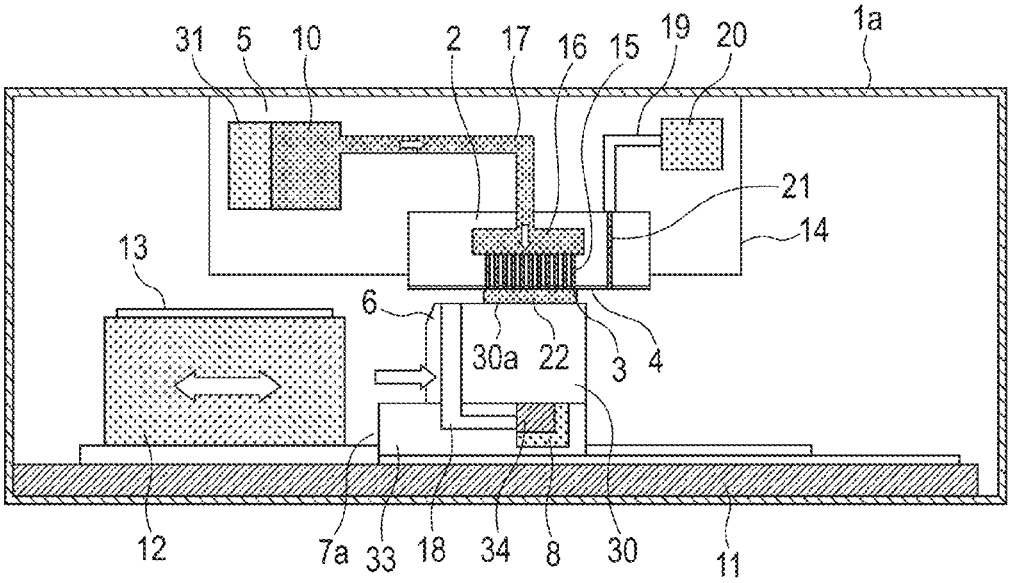
FIG. 7 is a view illustrating a state in which a liquid has been supplied to a recording head of the liquid discharge apparatus illustrated in FIG. 6.

FIG. 7 is a view illustrating a state in which the liquid has been supplied to the recording head 2 of the liquid discharge apparatus 1*a*.

The pressure control section 31 in the supply unit 5 controls a pressure generated by the pump thereof, and thereby supplies the liquid in the liquid tank 10 up to the surface of the discharge port surface 4.

The distance between the discharge port surface 4 and the one surface 30*a* of the liquid-holding portion 30 is a distance at which the liquid 22 on the discharge port surface 4 comes in contact with the one surface 30*a* of the liquid-holding portion 30. Because of this, the liquid 22 on the discharge port surface 4 is held in between the one surface 30*a* of the liquid-holding portion 30 and the discharge port surface 4, as is illustrated in FIG. 7.

Next, the movement of the liquid 22 on the discharge port surface 4 by the liquid moving unit 7*a* will be described below with reference to FIG. 8A to FIG. 8C. Incidentally, in FIG. 8A to FIG. 8C, the description about similar processes to those in FIG. 3A to FIG. 3C will be omitted.

Figure 8A:
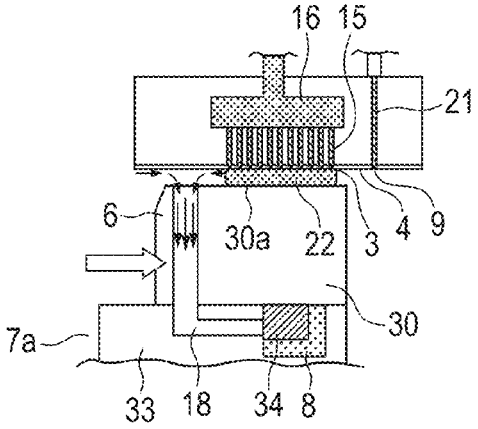
FIGS. 8A, 8B and 8C are views for describing the movement of a liquid on a discharge port surface, by a liquid moving unit illustrated in FIG. 6.
Figure 8B:
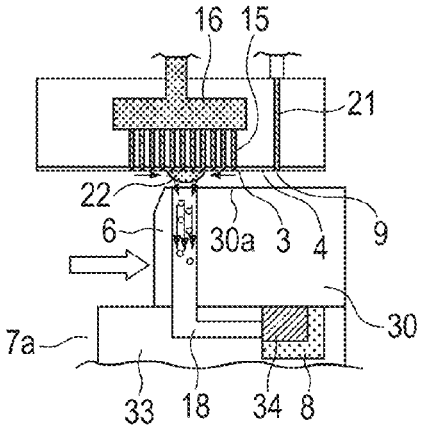
Figure 8C:
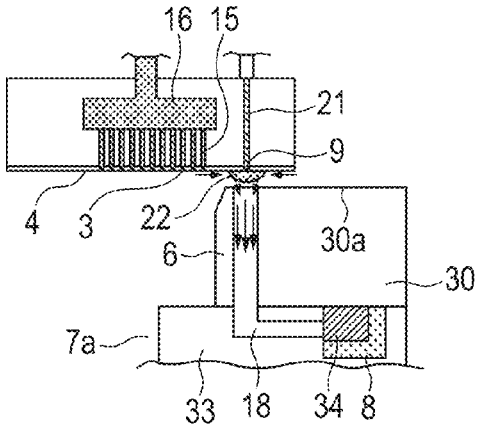

FIG. 8A is a view illustrating a state in which the liquid has been supplied up to the surface of the discharge port surface 4 by the supply unit 5.

As is illustrated in FIG. 8A, the liquid 22 on the discharge port surface 4 is held in between the discharge port surface 4 and the one surface 30*a* of the liquid-holding portion 30. When the moving section 33 has been moved to the direction (right direction) shown by the open arrow, a part of the liquid 22 on the discharge port surface 4 is sucked through the suction port 6 as is illustrated in FIG. 8B, because a pressure in the inside of the suction port 6 is controlled to −1 kPa, and is collected in an unillustrated liquid-storing portion in the controlling unit 8. In addition, a part of the liquid 22 on the discharge port surface 4 moves to the vicinity of the position on the discharge port surface 4, which faces the suction port 6, while being held on the discharge port surface 4, by the suction through the suction port 6.

Thus, the pressure in the inner part of the suction port 6 is controlled to an appropriate pressure, and thereby the liquid 22 held in between the discharge port surface 4 and the one surface 30*a* of the liquid-holding portion 30 can be moved on the discharge port surface 4.

The controlling unit 8 moves the liquid 22 on the discharge port surface 4 to the collection position which is the vicinity of the liquid collection port 9 in the present embodiment. Specifically, the controlling unit 8 moves the suction port 6 to a position facing the liquid collection port 9, as is illustrated in FIG. 8C. When having moved the suction port 6 to the position facing the liquid collection port 9, the controlling unit 8 stops the movement of the moving section 33. As has been described above, the liquid 22 on the discharge port surface 4 moves to the vicinity of the position on the discharge port surface 4, which faces the suction port 6, by the suction through the suction port 6. Because of this, the liquid 22 on the discharge port surface 4 also moves to the vicinity of the liquid collection port 9 which is the collection position.

Here, the pressure control section 31 in the supply unit 5 applies a negative pressure of −2 kPa, for instance, to the liquid in the liquid tank 10. By doing so, the liquid does not drip from the discharge port 3, is held there, and is set at a state in which the liquid can be discharged from the discharge port 3.

The liquid 22 which has been moved to the vicinity of the liquid collection port 9 is collected from the liquid collection port 9. An operation of collecting the liquid 22 from the liquid collection port 9 is similar to that in the first embodiment, and accordingly the description will be omitted.

Thus, the liquid discharge apparatus 1*a* of the present embodiment further has a liquid-holding portion 30 which holds the liquid 22 in between the discharge port surface 4 and the one surface 30*a*.

The liquid 22 on the discharge port surface 4 is held in between the one surface 30*a* of the liquid-holding portion 30 and the discharge port surface 4, and thereby the liquid 22 on the discharge port surface 4 can be more surely held. For this reason, the liquid-holding portion 30 prevents the liquid 22 from dropping, also moves the liquid 22 on the discharge port surface 4 to the position in which the discharge port 3 is not provided, and lowers the possibility that a deposited substance remains in the vicinity of the discharge port 3.

Third Embodiment

Figure 9A:
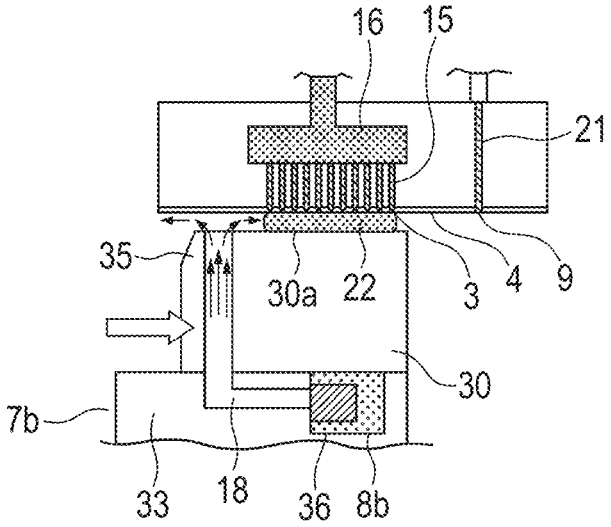
FIGS. 9A and 9B are views for describing the movement of a liquid on a discharge port surface, by a liquid moving unit of a third embodiment in the present invention.
Figure 9B:
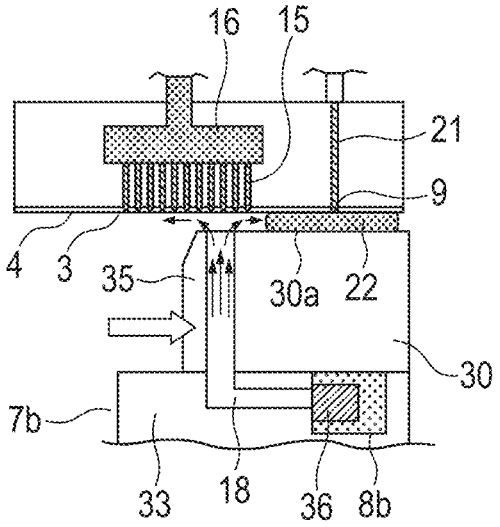

FIG. 9A and FIG. 9B are views for describing the movement of the liquid 22 on the discharge port surface 4, by a liquid moving unit 7*b* of a third embodiment of the present invention.

The liquid moving unit 7*b* of the present embodiment is different from the liquid moving unit 7*a* of the second embodiment, in the points that the suction port 6 is changed to a nozzle 35 and the controlling unit 8 is changed to a controlling unit 8*b*.

The nozzle 35 is mounted on the moving section 33 arranged apart from the discharge port surface 4, and is provided so as to be movable along the discharge port surface 4 according to the movement of the moving section 33.

The controlling unit 8*b* is different from the controlling unit 8, in the point that the negative-pressure generation mechanism 34 is changed to a positive pressure generating mechanism 36 which functions as a positive pressure generating unit.

The positive pressure generating mechanism 36 has a pump, a regulator and a pressure-detecting portion (though any of them is unillustrated). The positive pressure generating mechanism 36 operates the pump that the positive pressure generating mechanism 36 has, and controls a pressure which is generated by the pump, with the regulator and the pressure-detecting portion. Thereby, a positive pressure which is generated in the nozzle 35 can be controlled. A positive pressure which is generated in the nozzle 35 is controlled to +10 kPa, for instance. Air is blown from the nozzle 35 by the positive pressure in the nozzle 35. However, the positive pressure in the nozzle 35 is not limited to the above described numeric value.

Next, the movement of the liquid on the discharge port surface 4 by the liquid moving unit 7*b* will be described below.

As has been described in the second embodiment, the liquid 22 on the discharge port surface 4 is held in between the discharge port surface 4 and the one surface 30*a* of the liquid-holding portion 30.

The controlling unit 8*b* moves the moving section 33 to the direction (right direction) shown by the open arrow, while making the positive pressure generating mechanism 36 blow air from the nozzle 35, as is illustrated in FIG. 9A. The liquid 22 which is held in between the discharge port surface 4 and the one surface 30*a* of the liquid-holding portion 30 moves to the right direction on the discharge port surface 4 by the air blown from the nozzle 35, according to the movement of the moving section 33.

The controlling unit 8*b* moves the liquid 22 on the discharge port surface 4 to a collection position which is the vicinity of the liquid collection port 9 in the present embodiment. Specifically, the controlling unit 8*b* moves the liquid 22 which is held in between the discharge port surface 4 and the one surface 30*a* of the liquid-holding portion 30, to the vicinity of the liquid collection port 9 that is the collection position, as is illustrated in FIG. 9B. When the liquid 22 which is held in between the discharge port surface 4 and the one surface 30*a* of the liquid-holding portion 30 has been moved to the vicinity of the liquid collection port 9, the controlling unit 8*b* stops the movement of the moving section 33.

Here, the pressure control section 31 in the supply unit 5 applies a negative pressure of −2 kPa, for instance, to the liquid in the liquid tank 10. By doing so, the liquid does not drip from the discharge port 3, is held there, and is set at a state in which the liquid can be discharged from the discharge port 3.

The liquid 22 which has been moved to the vicinity of the liquid collection port 9 is collected from the liquid collection port 9. Incidentally, an operation of collecting the liquid 22 from the liquid collection port 9 is similar to that in the first embodiment, and accordingly the description will be omitted.

Thus, the liquid moving unit 7*b* of the present embodiment includes: the liquid-holding portion 30 which holds the liquid 22 on the discharge port surface 4 in between the liquid-holding portion 30 and the discharge port surface 4; and the nozzle 35 which is arranged apart from the discharge port surface 4 and can move along the discharge port surface 4. In addition, the liquid moving unit 7*b* of the present embodiment moves the liquid 22 which is held in between the one surface 30*a* of the liquid-holding portion 30 and the discharge port surface 4, to the position in which the discharge port 3 is not provided, with the air blown from the nozzle 35.

The liquid-holding portion 30 can hold the liquid 22 on the discharge port surface 4 in between the one surface 30*a* thereof and the discharge port surface 4, accordingly more surely holds the liquid 22 on the discharge port surface 4, and can prevent the drop, spattering or the like of the liquid 22. In addition, the liquid 22 which is held in between the one surface 30*a* of the liquid-holding portion 30 and the discharge port surface 4 is moved to the position in which the discharge port 3 is not provided, with the air blown from the nozzle 35, and accordingly the deposited substance such as the droplet and the foreign substance in the vicinity of the discharge port 3 can be removed. In addition, the liquid moving unit 7*b* is configured to be movable along the discharge port surface 4, and accordingly the occurrence of unevenness is suppressed in the region on the discharge port surface 4, from which the deposited substance is removed. Accordingly, such a possibility can be lowered that a deposited substance remains in the vicinity of the discharge port 3.

Fourth Embodiment

Figure 10A:
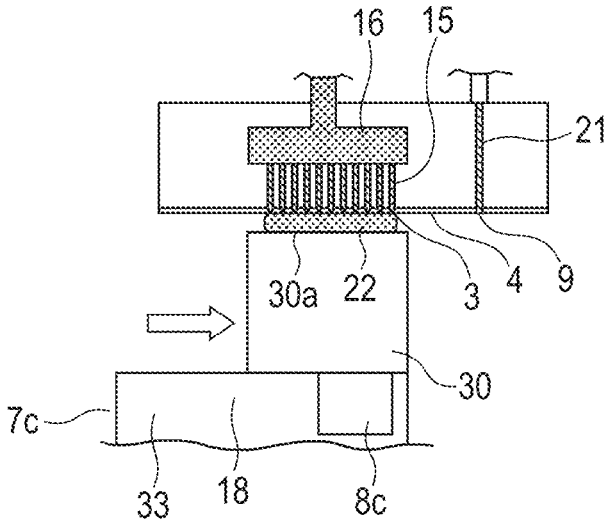
FIGS. 10A and 10B are views for describing the movement of a liquid on a discharge port surface, by a liquid moving unit of a fourth embodiment in the present invention.
Figure 10B:
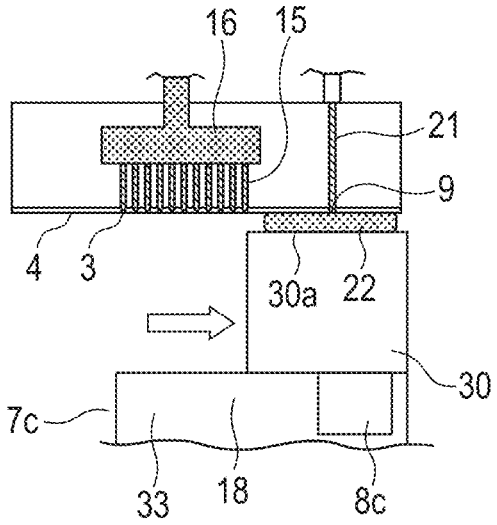

FIG. 10A and FIG. 10B are views for describing the movement of the liquid 22 on the discharge port surface 4, by a liquid moving unit 7*c* of a fourth embodiment in the present invention.

The liquid moving unit 7*c* of the present embodiment is different from the liquid moving unit 7*a* of the second embodiment, in the point that the suction port 6 is eliminated and the controlling unit 8 is changed to a controlling unit 8*c*.

The controlling unit 8*c* is different from the controlling unit 8, in the point that the negative-pressure generation mechanism 34 is eliminated.

Next, the movement of the liquid on the discharge port surface 4 by the liquid moving unit 7*c* will be described below.

As has been described in the second embodiment, the liquid 22 on the discharge port surface 4 is held in between the discharge port surface 4 and the one surface 30*a* of the liquid-holding portion 30.

As is illustrated in FIG. 10A, the controlling unit 8*c* moves the moving section 33 to the direction (right direction) shown by the open arrow, in a state in which the liquid 22 is held in between the discharge port surface 4 and the one surface 30*a* of the liquid-holding portion 30. The liquid 22 which is held in between the discharge port surface 4 and the one surface 30*a* of the liquid-holding portion 30 moves to the right direction on the discharge port surface 4, according to the movement of the moving section 33.

The controlling unit 8*c* moves the liquid 22 which is held in between the discharge port surface 4 and the one surface 30*a* of the liquid-holding portion 30, to the collection position which is the vicinity of the liquid collection port 9 in the present embodiment. Specifically, the controlling unit 8*c* moves the liquid 22 which is held in between the discharge port surface 4 and the one surface 30*a* of the liquid-holding portion 30, to the vicinity of the liquid collection port 9, as is illustrated in FIG. 10B. When the liquid 22 which is held in between the discharge port surface 4 and the one surface 30*a* of the liquid-holding portion 30 has been moved to the vicinity of the liquid collection port 9, the controlling unit 8*c* stops the movement of the moving section 33.

Here, the pressure control section 31 in the supply unit 5 applies a negative pressure of −2 kPa, for instance, to the liquid in the liquid tank 10. By doing so, the liquid does not drip from the discharge port 3, is held there, and is set at a state in which the liquid can be discharged from the discharge port 3.

The liquid 22 which has been moved to the vicinity of the liquid collection port 9 is collected from the liquid collection port 9. An operation of collecting the liquid 22 from the liquid collection port 9 is similar to that in the first embodiment, and accordingly the description will be omitted.

Incidentally, the one surface 30*a* of the liquid-holding portion 30 is formed from such a material as to be capable of moving the liquid 22 while holding the liquid 22 in between the one surface 30*a* and the discharge port surface 4. The one surface 30*a* of the liquid-holding portion 30 is formed, for instance, of a porous body. When the one surface 30*a* of the liquid-holding portion 30 is formed of the porous body, the porous body can move while absorbing a part of the liquid 22 therein and also holding the liquid 22 in between the one surface 30*a* and the discharge port surface 4.

Thus, the liquid moving unit 7*c* of the present embodiment is provided with the liquid-holding portion 30 which holds the liquid 22 in between the liquid-holding portion 30 and the discharge port surface 4, and moves the liquid 22 that is held in between the liquid-holding portion 30 and the discharge port surface 4, to the position in which the discharge port 3 is not provided.

The liquid-holding portion 30 can hold the liquid 22 on the discharge port surface 4 in between the one surface 30*a* thereof and the discharge port surface 4, accordingly more surely holds the liquid 22 on the discharge port surface 4, and can prevent the drop, spattering or the like of the liquid 22. In addition, the liquid 22 which is held in between the one surface 30*a* of the liquid-holding portion 30 and the discharge port surface 4 is moved to the position in which the discharge port 3 is not provided, by the movement of the liquid-holding portion 30, and accordingly the deposited substance such as the droplet and the foreign substance in the vicinity of the discharge port 3 can be removed. In addition, the liquid-holding portion 30 (the liquid moving unit 7*c*) is configured to be movable along the discharge port surface 4, accordingly the occurrence of the unevenness is suppressed in the region on the discharge port surface 4, from which the deposited substance is removed, and such a possibility can be lowered that the deposited substance remains in the vicinity of the discharge port 3. In addition, the pump and the like for moving the liquid on the discharge port surface 4 by the suction or the blowing of the air become unnecessary, and the configuration of the apparatus can be simplified.

Fifth Embodiment

Figure 11:
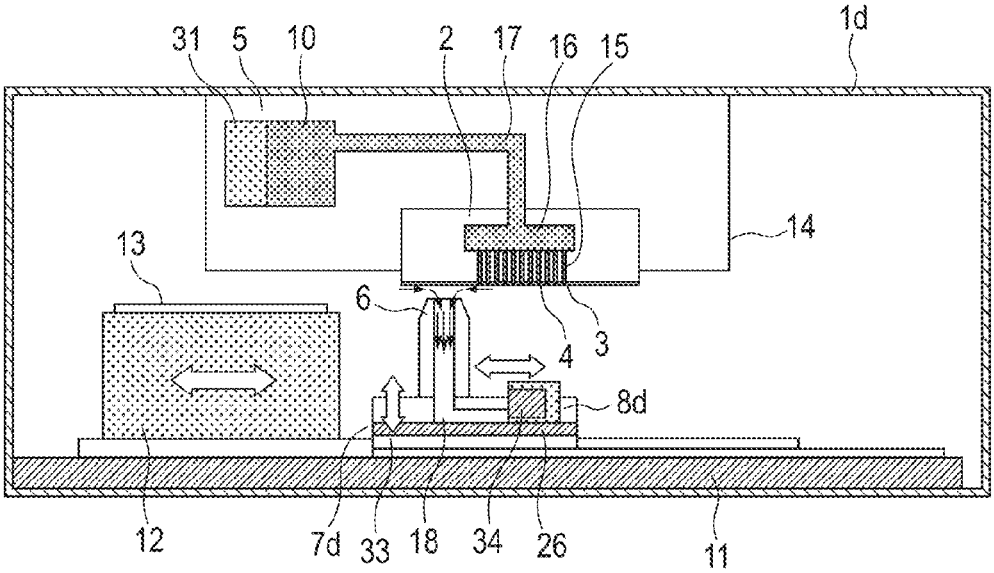
FIG. 11 is a cross-sectional view illustrating a configuration of a liquid discharge apparatus of a fifth embodiment in the present invention.

FIG. 11 is a cross-sectional view illustrating a configuration of a liquid discharge apparatus 1*d* of a fifth embodiment in the present invention.

The liquid discharge apparatus 1*d* of the present embodiment is different from the liquid discharge apparatus 1 of the first embodiment, in the points that the liquid collection port 9, the liquid collecting flow path 21, the flow channel 19 connected to the liquid-collection unit and the liquid-collection unit 20 are eliminated, and that the liquid moving unit 7 is changed to a liquid moving unit 7*d*.

The liquid moving unit 7*d* is different from the liquid moving unit 7, such that the liquid moving unit 7*d* includes an elevating portion 26 and a controlling unit 8*d* rather than the controlling unit 8 found in the liquid moving unit 7.

The elevating portion 26 is mounted on the moving section 33, and the suction port 6 is mounted on the elevating portion 26. The elevating portion 26 is configured so as to be movable in the vertical direction with respect to the moving section 33, in FIG. 11. When the elevating portion 26 is moved in the vertical direction, the suction port 6 likewise moves in the vertical direction. Accordingly, a distance between the suction port 6 and the discharge port surface 4 can be changed by the elevating portion 26.

Figure 12A:
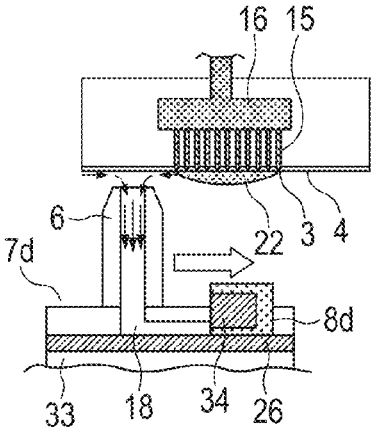
FIGS. 12A, 12B and 12C are views for describing the movement of a liquid on a discharge port surface, by a liquid moving unit illustrated in FIG. 11.

Next, the movement of the liquid on the discharge port surface 4 of the recording head 2 by the liquid moving unit 7*d* will be described below with reference to FIG. 12A to FIG. 12C.

A method for moving the liquid 22 on the discharge port surface 4 by the liquid moving unit 7*d* is similar to that in the first embodiment. Specifically, as is illustrated in FIG. 12A, the controlling unit 8*d* moves the suction port 6 along the discharge port surface 4 to the direction (right direction) shown by the open arrow in FIG. 12A, in a state in which the liquid is sucked through the suction port 6.

Figure 12B:
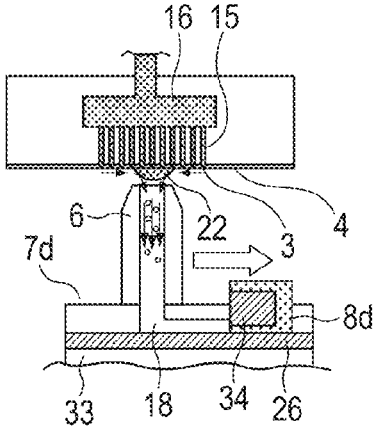

As is illustrated in FIG. 12B, a part of the liquid 22 on the discharge port surface 4 is sucked through the suction port 6 by the suction through the suction port 6, and is collected in an unillustrated liquid-storing portion in the controlling unit 8*d* through the suction flow channel 18. In addition, a part of the liquid 22 on the discharge port surface 4 moves to the vicinity of the position on the discharge port surface 4, which faces the suction port 6, while being held on the discharge port surface 4.

Figure 12C:
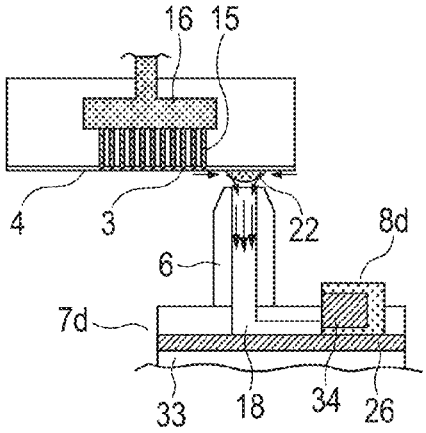

The controlling unit 8*d* further moves the suction port 6, and moves the liquid 22 on the discharge port surface 4 to a collection position in which the discharge port 3 is not provided, as is illustrated in FIG. 12C. At this position, the liquid 22 on the discharge port surface 4 is collected by the liquid moving unit 7*d*.

Next, the operation of collecting the liquid 22 on the discharge port surface 4 by the liquid moving unit 7*d* will be described below with reference to FIG. 13A and FIG. 13B.

The controlling unit 8*d* controls a pressure in the inner part of the suction port 6 to −20 kPa of which the absolute value is larger than that at the time when the liquid 22 on the discharge port surface 4 moves, by the negative-pressure generation mechanism 34. However, the pressure in the inner part of the suction port 6 is not limited to the above described numeric value.

Figure 13A:
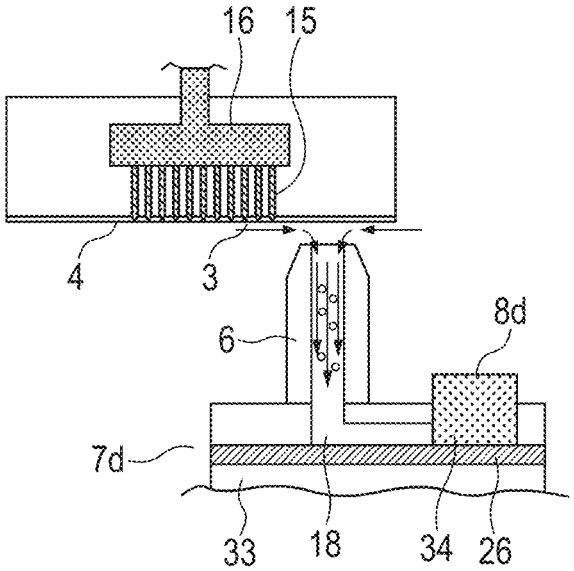
FIGS. 13A and 13B are views for describing an operation of collecting a liquid by the liquid moving unit illustrated in FIG. 11.

When the pressure (negative pressure) in the inner part of the suction port 6 is increased to −20 kPa from −10 kPa, a sucking force from the discharge port 6 for the liquid 22 on the discharge port surface 4 thereby increases, and the liquid 22 on the discharge port surface 4 is sucked by the suction port 6, as is illustrated in FIG. 13A. The liquid which has been sucked through the suction port 6 is collected in an unillustrated liquid-storing portion in the controlling unit 8*d* through the suction flow channel 18.

Figure 13B:
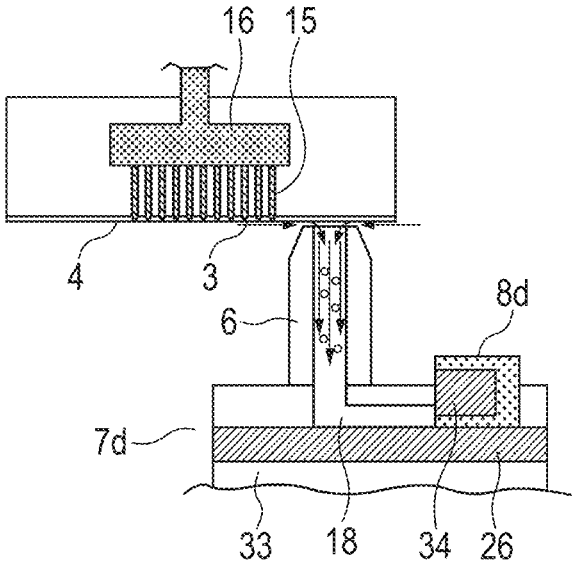

Here, as is illustrated in FIG. 13B, the controlling unit 8*d* operates the elevating portion 26, and makes the suction port 6 approach the discharge port surface 4. When the suction port 6 approaches the discharge port surface 4, the sucking force from the discharge port 6 for the liquid 22 on the discharge port surface 4 thereby further increases, and the liquid on the discharge port surface 4 becomes easily removed.

Thus, the liquid moving unit 7*d* of the present embodiment moves the liquid 22 on the discharge port surface 4 to a position in which the discharge port 3 is not provided, and then makes the liquid 22 sucked through the suction port 6 and collected. In addition, the liquid moving unit 7*d* is provided with the elevating portion 26 which changes the distance between the suction port 6 and the discharge port surface 4, and causes the elevating portion 26 to make the suction port 6 approach to the discharge port surface 4, when collecting the liquid 22 on the discharge port surface 4.

Because the liquid 22 on the discharge port surface 4 is collected through the suction port 6, a structure for collecting the liquid 22 on the discharge port surface 4 does not need to be separately provided, and accordingly the configuration of the apparatus can be simplified. In addition, when the suction port 6 approaches the discharge port surface 4, the sucking force from the suction port 6 for the liquid 22 on the discharge port surface 4 thereby increases, and accordingly the liquid 22 on the discharge port surface 4 becomes easily removed.

Sixth Embodiment

Figure 14:
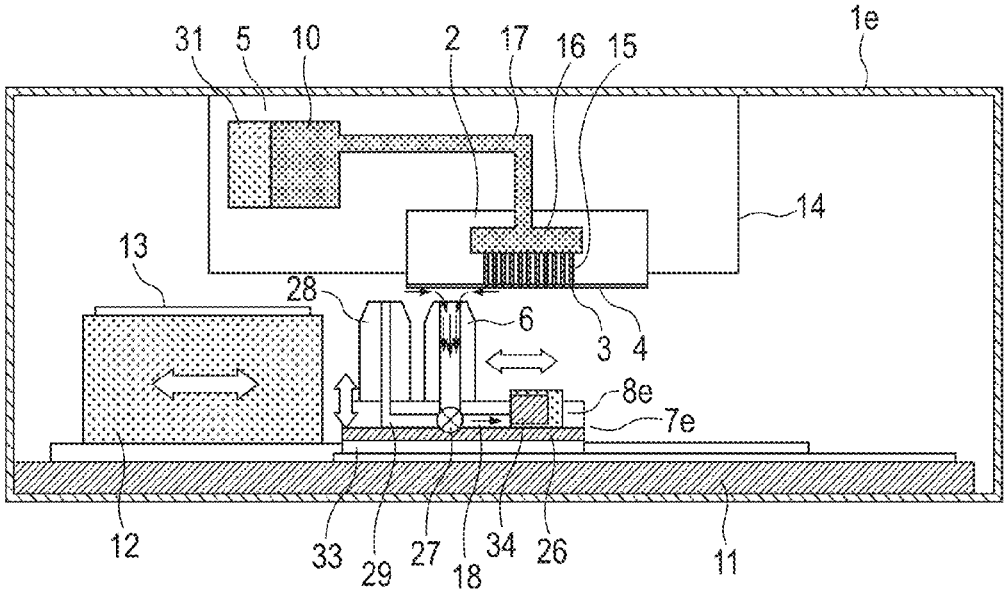
FIG. 14 is a cross-sectional view illustrating a configuration of a liquid discharge apparatus of a sixth embodiment in the present invention.

FIG. 14 is a cross-sectional view illustrating a configuration of a liquid discharge apparatus 1*e* of a sixth embodiment in the present invention.

The liquid discharge apparatus 1*e* of the present embodiment is different from the liquid discharge apparatus 1*d* of the fifth embodiment, in the point that the liquid moving unit 7*d* is changed to a liquid moving unit 7*e*.

The liquid moving unit 7*e* is different from the liquid moving unit 7*d*, in the points that a liquid-collection suction port 28, a liquid-collection suction port flow channel 29 and a three-way valve 27 are added, and that the controlling unit 8*d* is changed to a controlling unit 8*e*. The liquid-collection suction port 28, the liquid-collection suction port flow channel 29 and the three-way valve 27 are mounted on the elevating portion 26.

The liquid-collection suction port 28 suctions the discharge port surface 4, and communicates with the liquid-collection suction port flow channel 29. Incidentally, the opening area of the liquid-collection suction port 28 is smaller than the opening area of the suction port 6.

The liquid-collection suction port flow channel 29 communicates with the three-way valve 27.

The three-way valve 27 communicates with the liquid-collection suction port flow channel 29, the suction port 6 and the suction flow channel 18. The three-way valve 27 makes the suction port 6 and the suction flow channel 18 communicate with each other, or the liquid-collection suction port flow channel 29 and the suction flow channel 18 communicate with each other. Accordingly, the liquid is sucked from the liquid-collection suction port flow channel 29 or the suction port 6.

Figure 15A:
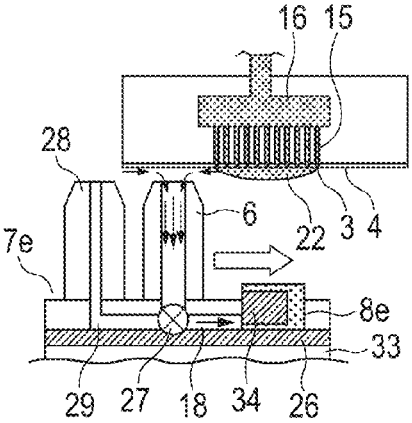
FIGS. 15A, 15B and 15C are views for describing the movement of a liquid on a discharge port surface, by a liquid moving unit illustrated in FIG. 14.

Next, the movement of the liquid 22 on the discharge port surface 4 by the liquid moving unit 7*e* will be described below with reference to FIG. 15A to FIG. 15C. Incidentally, in FIG. 15A to FIG. 15C, the descriptions about similar processes to those in FIG. 12A to FIG. 12C will be omitted.

When moving the liquid 22 on the discharge port surface 4, the controlling unit 8*e* controls the three-way valve 27 to make the suction port 6 and the suction flow channel 18 communicate with each other. By doing so, the liquid is sucked through the suction port 6.

A method for moving the liquid 22 on the discharge port surface 4 by the liquid moving unit 7*e* is similar to that in the first embodiment. Specifically, as is illustrated in FIG. 15A, the controlling unit 8*d* moves the suction port 6 along the discharge port surface 4 to the direction (right direction) shown by the open arrow in FIG. 15A, in a state in which the liquid is sucked through the suction port 6.

Figure 15B:
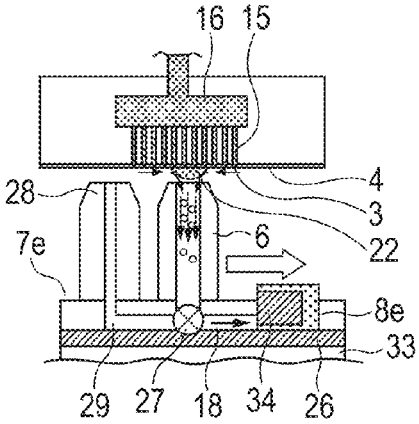

As is illustrated in FIG. 15B, a part of the liquid 22 on the discharge port surface 4 is sucked through the suction port 6 by the suction through the suction port 6, and is collected in an unillustrated liquid-storing portion in the controlling unit 8*e* through the suction flow channel 18. In addition, a part of the liquid 22 on the discharge port surface 4 moves to the vicinity of the position on the discharge port surface 4, which faces the suction port 6, while being held on the discharge port surface 4.

Figure 15C:
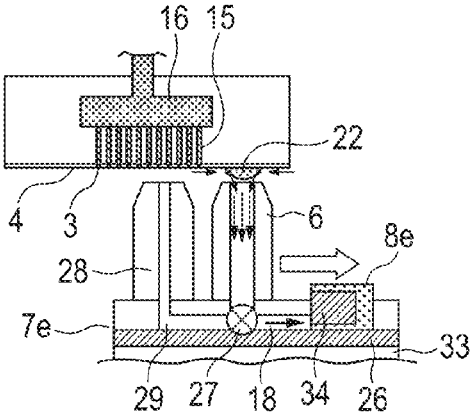

The controlling unit 8*e* further moves the suction port 6, and moves the liquid 22 on the discharge port surface 4 to a collection position in which the discharge port 3 is not provided, as is illustrated in FIG. 15C. At this position, the liquid 22 on the discharge port surface 4 is collected by the liquid moving unit 7*e*.

Next, the operation of collecting the liquid 22 on the discharge port surface 4 by the liquid moving unit 7*e* will be described below with reference to FIG. 16A and FIG. 16B.

Firstly, the controlling unit 8*e* makes the moving section 33 move the liquid-collection suction port 28 to a position on the discharge port surface 4, which faces the collection position of the liquid 22. In addition, the controlling unit 8*e* controls the three-way valve 27 to make the liquid-collection suction port flow channel 29 and the suction flow channel 18 communicate with each other. By doing so, the liquid is sucked from the liquid-collection suction port flow channel 29.

Next, the controlling unit 8*e* controls a pressure in the inner part of the liquid-collection suction port 28 to −20 kPa of which the absolute value is larger than that at the time when the liquid 22 on the discharge port surface 4 moves, by the negative-pressure generation mechanism 34. However, the pressure in the inner part of the liquid-collection suction port 28 is not limited to the above described numeric value.

Figure 16A:
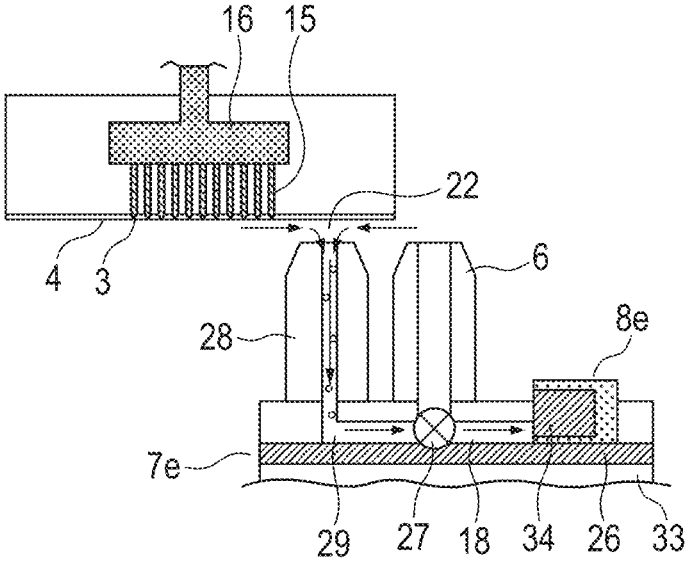
FIGS. 16A and 16B are views for describing an operation of collecting a liquid by the liquid moving unit illustrated in FIG. 14.

When the pressure (negative pressure) in the inner part of the liquid-collection suction port 28 is increased to −20 kPa from −10 kPa, a sucking force thereby increases, and the liquid 22 on the discharge port surface 4 is sucked by the liquid-collection suction port 28, as is illustrated in FIG. 16A. The liquid which has been sucked from the liquid-collection suction port 28 is collected in an unillustrated liquid-storing portion in the controlling unit 8*e* through the liquid-collection suction port flow channel 29 and the suction flow channel 18.

As has been described above, the opening area of the liquid-collection suction port 28 is smaller than the opening area of the suction port 6. Accordingly, if the pressure generated by the pump is equal which the negative-pressure generation mechanism 34 has, the sucking force from the liquid-collection suction port 28 becomes larger than the sucking force through the suction port 6. Because of this, the liquid 22 on the discharge port surface 4 can be sucked by a stronger sucking force from the liquid-collection suction port 28 than through the suction port 6.

Figure 16B:
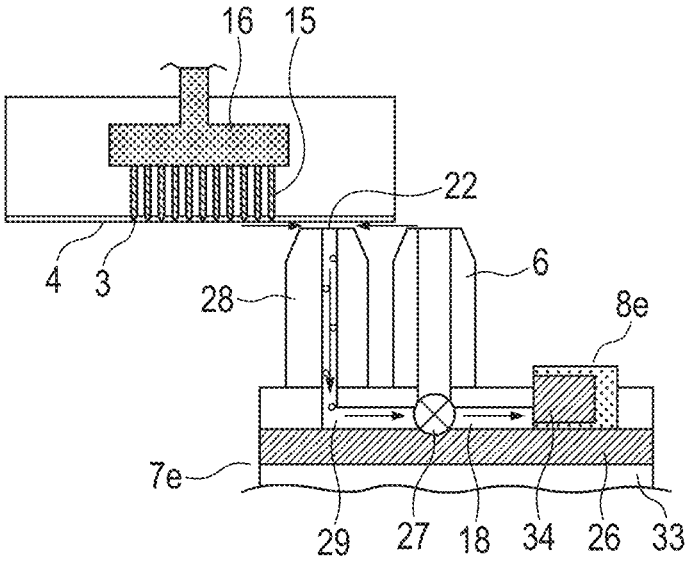

Here, as is illustrated in FIG. 16B, the controlling unit 8*e* operates the elevating portion 26, and makes the liquid-collection suction port 28 approach the discharge port surface 4. When the liquid-collection suction port 28 approaches the discharge port surface 4, the sucking force from the liquid-collection suction port 28 for the liquid 22 on the discharge port surface 4 thereby further increases, and the liquid 22 on the discharge port surface 4 becomes easily removed.

Thus, the liquid moving unit 7*e* of the present embodiment further includes the liquid-collection suction port 28 having an opening area smaller than that of the suction port 6. The liquid moving unit 7*e* moves the liquid 22 on the discharge port surface 4 to the position in which the discharge port 3 is not provided, by the suction through the suction port 6, and then the liquid-collection suction port 28 sucks the liquid 22 on the discharge port surface 4 by the suction through the liquid-collection suction port 28. In addition, when collecting the liquid on the discharge port surface 4, the liquid moving unit 7*e* causes the elevating portion 26 to make the liquid-collection suction port 28 approach the discharge port surface 4.

The opening area of the liquid-collection suction port 28 is smaller than the opening area of the suction port 6, and accordingly the sucking force through the liquid-collection suction port 28 is larger than the sucking force through the suction port 6. Because of this, the liquid 22 on the discharge port surface 4 is sucked through the liquid-collection suction port 28, and thereby the liquid 22 on the discharge port surface 4 becomes more easily removed. In addition, when the liquid-collection suction port 28 approaches the discharge port surface 4, the sucking force through the liquid-collection suction port 28 for the liquid 22 on the discharge port surface 4 thereby increases, and the liquid on the discharge port surface 4 becomes further easily removed.

Seventh Embodiment

Figure 17A:
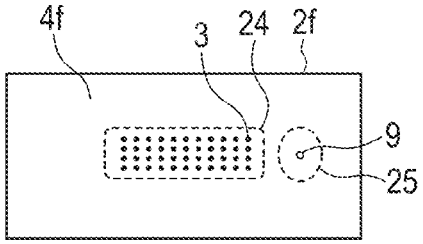
FIGS. 17A and 17B are views of a recording head of a seventh embodiment in the present invention, which is viewed from a discharge port surface side.

FIG. 17A is a view of a recording head 2*f* of a seventh embodiment in the present invention, which is viewed from a discharge port surface side.

On a discharge port surface 4*f* of the recording head 2*f*, a lyophilic treatment portion 25 having lyophilic properties is provided in the periphery of the liquid collection port 9. In addition, a liquid-repellent treatment portion 24 having liquid repellency is provided in the periphery of the discharge port 3.

In the first to third embodiments, the liquid 22 on the discharge port surface 4 is moved to the vicinity of the liquid collection port 9 which is a collection position. Because the lyophilic treatment portion 25 is provided in the periphery of the liquid collection port 9, thereby the liquid 22 tends to easily adhere on the surface of the lyophilic treatment portion 25, and accordingly the liquid 22 becomes easily held in the periphery of the liquid collection port 9. As a result, the liquid 22 becomes easily collected from the liquid collection port 9.

In addition, the liquid-repellent treatment portion 24 is provided in the periphery of the discharge port 3, and thereby the liquid 22 resists adhering on the liquid-repellent treatment portion 24. Because of this, when the droplet is discharged from the discharge port 3, such a problem resists occurring that the discharged droplet comes in contact with the droplet which has adhered on the periphery of the discharge port 3 and the discharge direction of the droplet is bent. In addition, when the liquid-repellent treatment portion 24 is provided not only in the periphery of the discharge port 3 but also on a region other than the lyophilic treatment portion 25, in which the liquid 22 is moved, the liquid 22 thereby becomes easily moved to the lyophilic treatment portion 25.

Figure 17B:
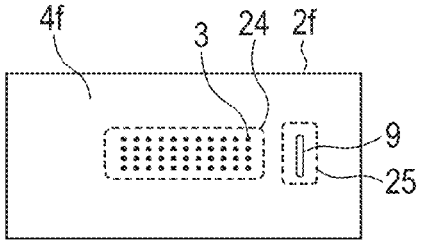

The shape of the liquid collection port 9 is not limited to a circle as illustrated in FIG. 17A. As is illustrated in FIG. 17B, the shape may be an oval shape, and may also be an elliptical shape, a square, a rectangle or the like.

Thus, on the discharge port surface 4*f* of the recording head 2*f* of the present embodiment, the lyophilic treatment portion 25 having the lyophilic properties is provided in the periphery of the liquid collection port 9. In addition, the liquid-repellent treatment portion 24 having the repellency is provided in the periphery of the discharge port 3.

Because of this, it becomes easy that the liquid 22 adheres on and is held in the periphery of the liquid collection port 9, and accordingly the liquid 22 becomes easily collected from the liquid collection port 9. In addition, the liquid 22 resists adhering on the periphery of the discharge port 3, and accordingly such a problem resists occurring that the discharged droplet comes in contact with the droplet which has adhered on the periphery of the discharge port 3 and the discharge direction of the droplet is bent.

Eighth Embodiment

Figure 18:
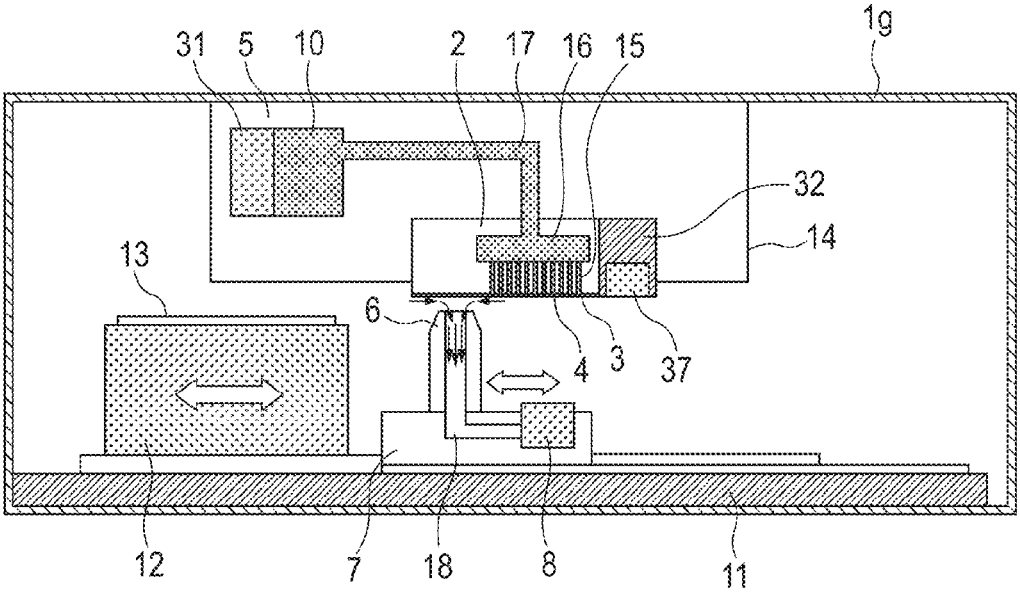
FIG. 18 is a cross-sectional view illustrating one example of a configuration of a liquid discharge apparatus of an eighth embodiment in the present invention.

FIG. 18 is a cross-sectional view illustrating one example of a configuration of a liquid discharge apparatus 1*g* of an eighth embodiment in the present invention.

The liquid discharge apparatus 1*g* of the present embodiment is different from the liquid discharge apparatus 1 of the first embodiment illustrated in FIG. 5, such that the liquid collection port 9, the liquid collecting flow path 21, the flow channel 19 connected to the liquid-collection unit and the liquid-collection unit 20 are eliminated, and that a liquid-collection body 37 is added.

The liquid-collection body 37 which functions as a collecting unit that collects a liquid in the vicinity of a collection position has one surface which exists approximately on the same plane as the discharge port surface 4, and is arranged in a position in which the discharge port 3 is not provided. However, when a distance between the discharge ports 3 is large, the liquid-collection body 37 may be provided between the discharge ports 3.

In the present embodiment, the liquid moving unit 7 moves the liquid 22 on the discharge port surface 4, to the vicinity of the liquid-collection body 37, as a collection position.

Figure 19A:
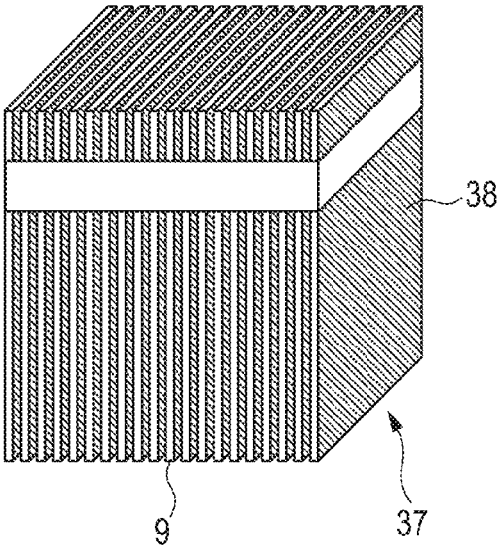
FIGS. 19A, 19B and 19C are views illustrating one example of the configuration of a liquid-collection body illustrated in FIG. 18.

FIG. 19A is a view illustrating a configuration example of the liquid-collection body 37.

The liquid-collection body 37 is desirably formed from a material (for instance, stainless steel) which can be previously cleaned so that the liquid-collection body itself does not become a source of generating a foreign substance.

As is illustrated in FIG. 19A, the liquid-collection body 37 has a structure in which at least two or more liquid-collection members 38 are overlapped that are plate materials made from stainless steel and have the surfaces which have a concave shape, a convex shape or both of the shapes formed thereon by etching.

Figure 19B:
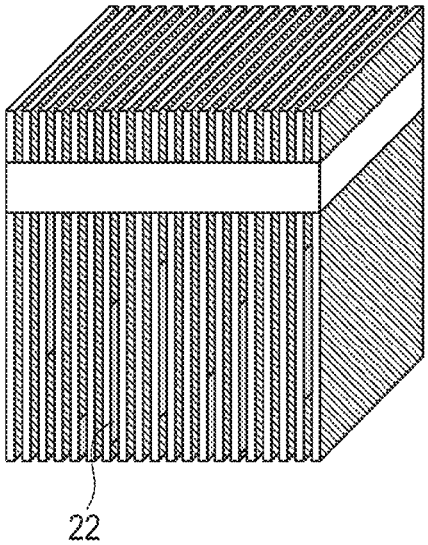

Due to the above described configuration, a capillary force is generated in fine spaces between the surfaces of the overlapped liquid-collection members 38, as is illustrated in FIG. 19B, and the liquid 22 which has moved to the vicinity of the liquid-collection body 37 is absorbed in the fine spaces. A distance between the liquid-collection members 38 is 100 μm, for instance. However, the distance between the surfaces of the liquid-collection members 38 is not limited to the above described numeric value.

Figure 19C:
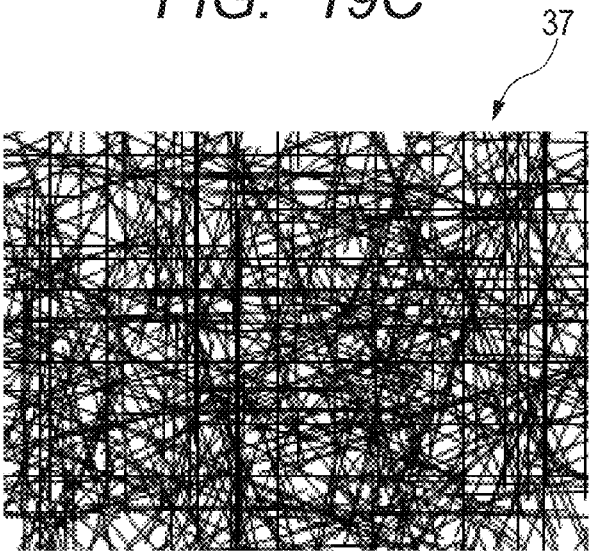

In addition, the liquid-collection body 37 may have, for instance, a structure in which stainless steel fibers are brought close to each other, as is illustrated in FIG. 19C. Even when the liquid-collection body 37 has the structure illustrated in FIG. 19C, the liquid 22 is absorbed in between the stainless steel fibers, by the capillary force.

The liquid discharge apparatus 1*g* of the present embodiment is not limited to such a structure that the liquid-collection body 37 is provided on the head guide portion 32, as is illustrated in FIG. 18.

Figure 20A:
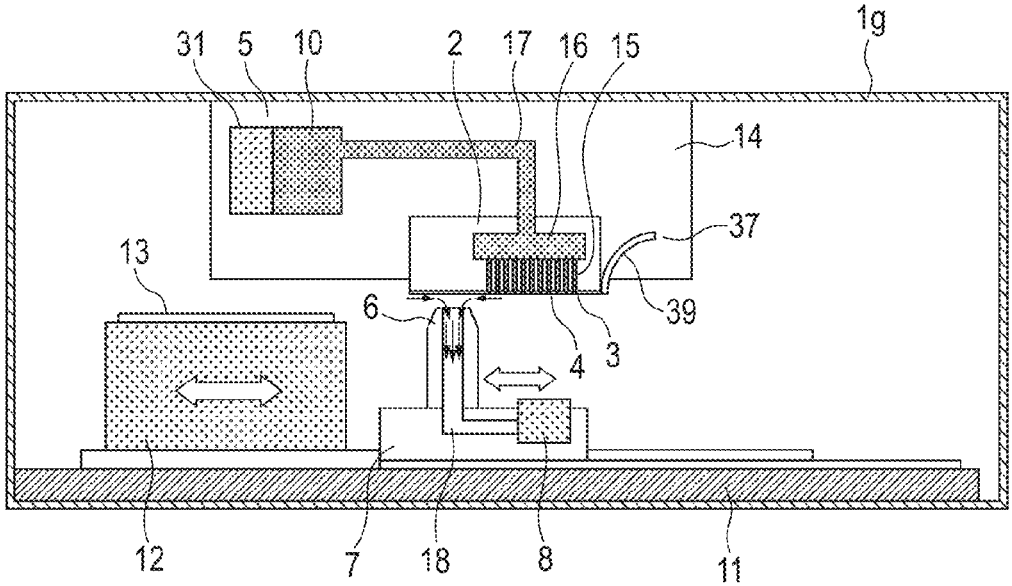
FIG. 20A is a cross-sectional view illustrating another example of a configuration of the liquid discharge apparatus of the eighth embodiment in the present invention.

FIG. 20A is a view illustrating another example of the structure of the liquid discharge apparatus 1*g* of the present embodiment.

The liquid discharge apparatus 1*g* illustrated in FIG. 20A is different from the liquid discharge apparatus 1 illustrated in FIG. 1A in the points that the liquid collection port 9, the liquid collecting flow path 21, the flow channel 19 connected to the liquid-collection unit and the liquid-collection unit 20 are eliminated, and that the liquid-collection body 37 is added.

In the liquid discharge apparatus 1*g* illustrated in FIG. 20A, a plate spring 39 is provided as the liquid-collection body 37.

The plate spring 39 is provided in a position which forms approximately the same plane as the discharge port surface 4 and in which the discharge port 3 is not provided, so as to be pressed to the recording head 2. In this case, the liquid moving unit 7 moves the liquid 22 on the discharge port surface 4, to the vicinity of the plate spring 39, as the collection position.

Figure 20B:
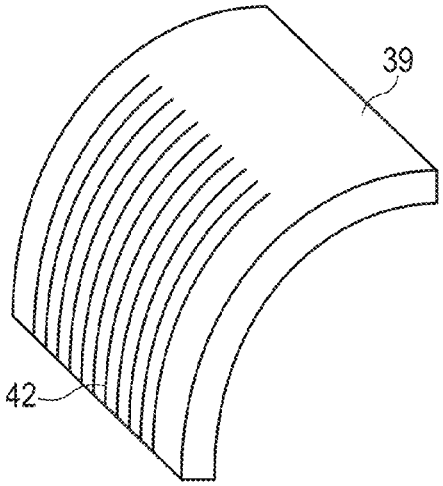
FIG. 20B is a view illustrating a configuration of a plate spring illustrated in FIG. 20A.

FIG. 20B is a view illustrating a structure of the plate spring 39.

As is illustrated in FIG. 20B, a fine groove portion 42 is provided in the plate spring 39. The plate spring 39 is arranged so that the groove portion 42 comes in contact with the discharge port surface 4. Because of this, when the liquid 22 on the discharge port surface 4 moves to the vicinity of the plate spring 39, the liquid 22 is absorbed in a gap of the groove portion 42 of the plate spring 39 by the capillary force. Here, a pressing force by which the plate spring 39 presses the recording head 2 is 200 gf, for instance. However, the pressing force of the plate spring 39 is not limited to the above described numeric value.

Thus, the liquid discharge apparatus 1*g* of the present embodiment has the liquid-collection body 37 which collects the liquid 22 on the discharge port surface 4 of the recording head 2 by the capillary force.

Because of this, a component such as a pump does not need to be provided for collecting the liquid 22 on the discharge port surface 4, and accordingly the configuration of the apparatus can be simplified.

Ninth Embodiment

Figure 21A:
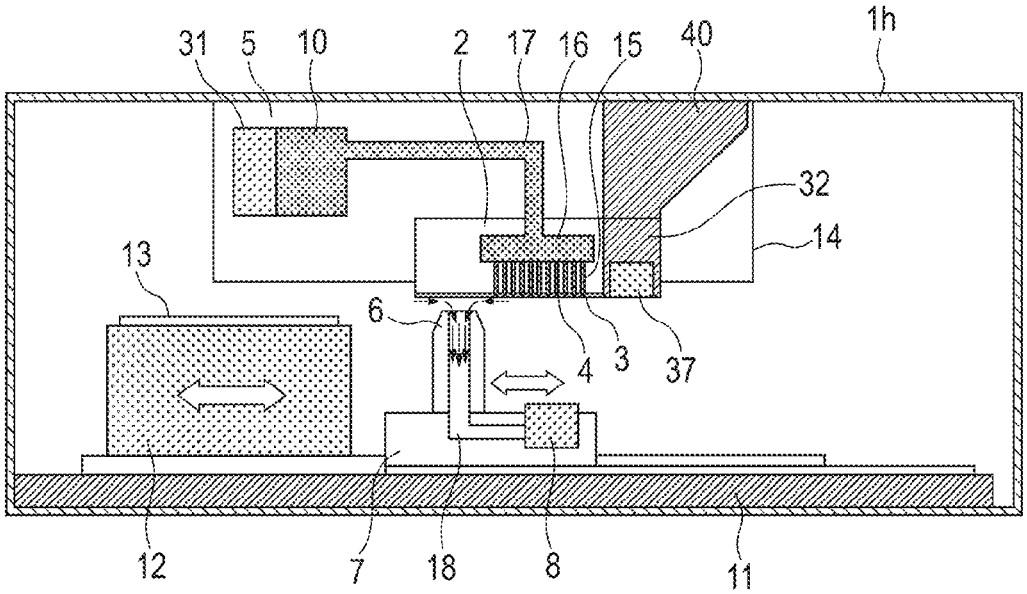
FIG. 21A is a cross-sectional view illustrating a configuration of a liquid discharge apparatus of a ninth embodiment in the present invention.

FIG. 21A is a cross-sectional view illustrating a configuration of a liquid discharge apparatus 1*h* of a ninth embodiment in the present invention.

The liquid discharge apparatus 1*h* of the present embodiment is different from the liquid discharge apparatus 1*g* of the eighth embodiment illustrated in FIG. 18, in the point that a suction ventilation tube 40 is added.

The suction ventilation tube 40 is arranged so as to surround the liquid-collection body 37, and is connected with an unillustrated negative pressure generating unit. The negative pressure generating unit generates and maintains the negative pressure, and thereby the liquid collected by the liquid-collection body 37 is sucked through the suction ventilation tube 40. Because of this, the liquid 22 collected by the liquid-collection body 37 can be prevented from drying/solidifying therein, and from dropping onto and adhering on the object to be drawn 13.

Figure 21B:
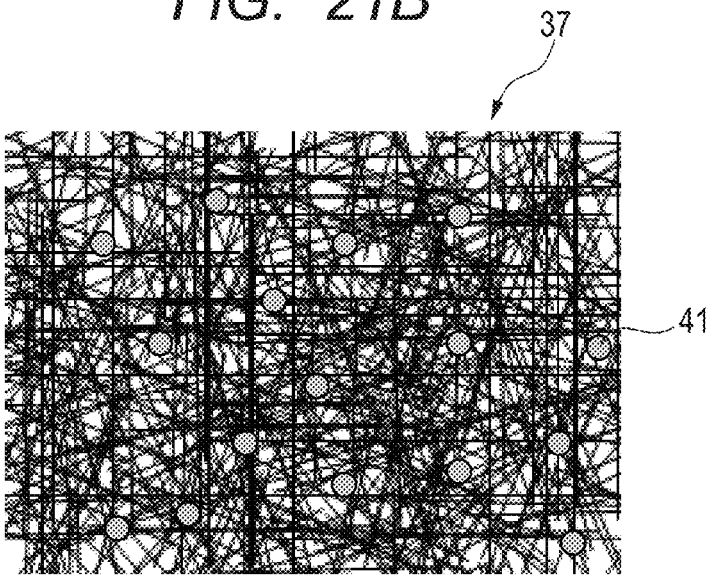
FIG. 21B is a view illustrating a configuration of a liquid-collection body illustrated in FIG. 21A.

After the liquid-collection body 37 has been washed, the liquid-collection body 37 may be impregnated with a non-volatile liquid or a liquid 41 with high water-retentivity, for instance, glycerin, as is illustrated in FIG. 21B. By doing so, the liquid 22 collected by the liquid-collection body 37 can be prevented from drying/solidifying in the liquid-collection body 37.

Thus, the liquid discharge apparatus 1*h* of the present embodiment has the suction ventilation tube 40 for absorbing the liquid collected by the liquid-collection body 37.

Because of this, the liquid collected by the liquid-collection body 37 is sucked through the suction ventilation tube 40, and accordingly can be prevented from drying/solidifying in the liquid-collection body 37, and from dropping onto and adhering on the object to be drawn 13.

Tenth Embodiment

Figure 22A:
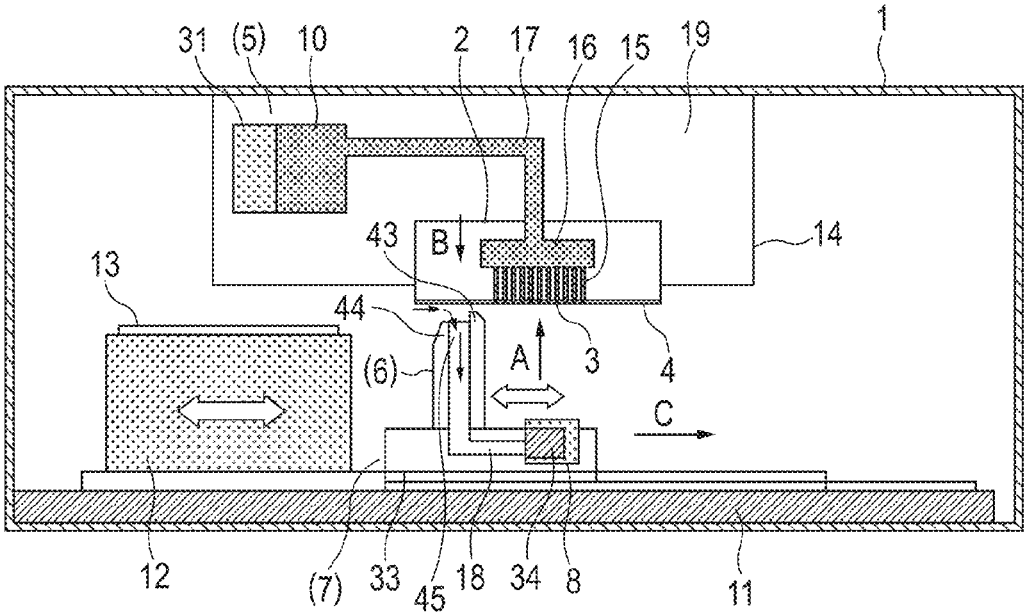
FIGS. 22A, 22B and 22C are views for describing a tenth embodiment.

FIG. 22A is a cross-sectional view illustrating a configuration of a liquid discharge apparatus 1 of the present embodiment. As is illustrated in FIG. 22A, a liquid moving unit 7 (negative pressure generating unit) is mounted on the base plate 11. Incidentally, the liquid moving unit 7 includes the suction port 6 and the moving section 33.

Figure 22B:
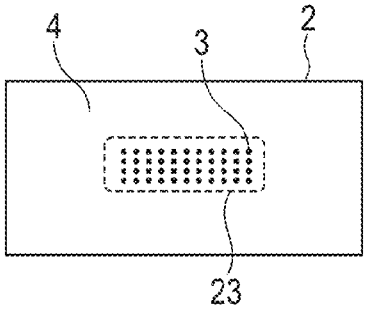

FIG. 22B is a view of a discharge port surface 4 which is viewed from the direction of the arrow A illustrated in FIG. 22A.

Figure 22C:
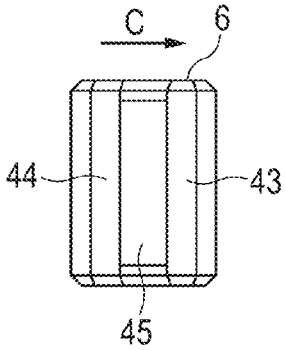

FIG. 22C is a view of an end of the suction port 6, which is viewed from the direction of the arrow B illustrated in FIG. 22A.

As is illustrated in FIG. 22A or FIG. 22C, the suction port 6 includes a liquid-holding portion 43 (first counter surface portion), a rear opening 44 (second counter surface portion) and a liquid-collection opening 45 (suction opening), in the end surface facing the discharge port surface 4.

Specifically, the liquid-holding portion 43 is arranged on a more forward side along the moving direction (arrow direction C) of the moving section 33 than the liquid-collection opening 45, so as to be arranged apart from the discharge port surface 4 at a first distance (for instance, 0.3 mm).

On the other hand, the rear opening 44 is arranged on a more backward side along the moving direction of the moving section 33 than the liquid-collection opening 45, so as to be arranged apart from the discharge port surface 4 at a second distance which is longer than the first distance (for instance, 0.5 mm).

Incidentally, in the present embodiment, the suction port 6 moves the liquid on the discharge port surface 4, while moving along the direction C.

In addition, a distance between the discharge port surface 4 and the rear opening 44 is set to be longer than a distance between the discharge port surface 4 and the liquid-holding portion 43, and thereby the "tail wind" effect which will be described below is obtained.

Furthermore, in the present embodiment, the shape of the suction port 6 (liquid-collection opening 45) has been determined to be a rectangle, but may be determined to be a shape such as an elliptical shape, a circle, a square and an oval shape.

Figure 23:
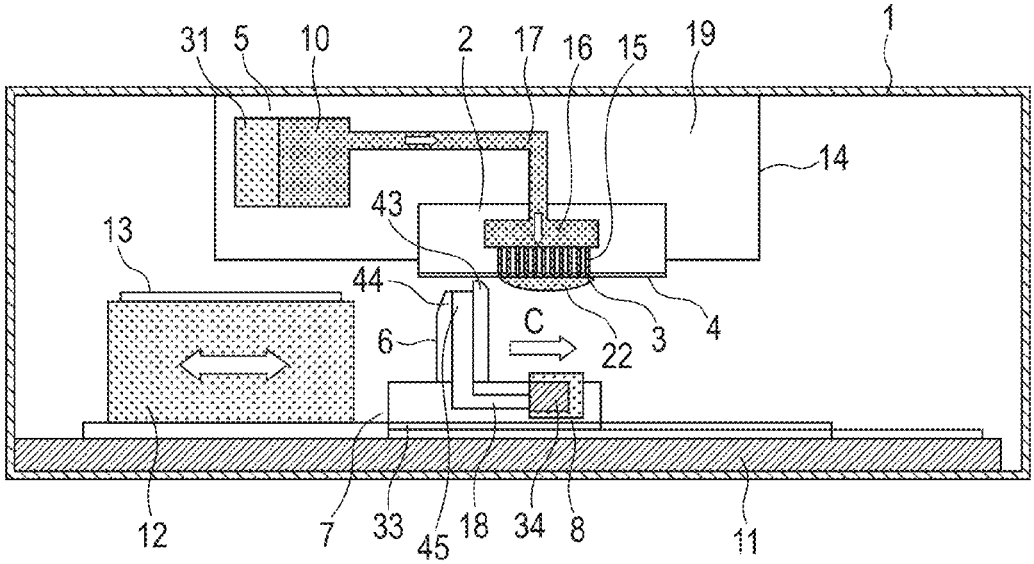
FIG. 23 is a view illustrating a state in which a liquid has been supplied to a recording head.

FIG. 23 is a view illustrating a state in which the liquid has been supplied to the recording head 2.

Hereafter, the movement state of the liquid 22 on the discharge port surface 4 by the liquid moving unit 7 (negative pressure generating unit) will be described with reference to FIG. 24A to FIG. 24C.

Figure 24A:
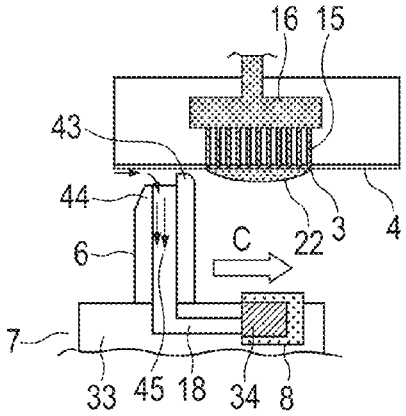
FIG. 24A is a view illustrating a state in which a liquid has been supplied up to the surface of the discharge port surface by a supply unit.
Figure 24B:
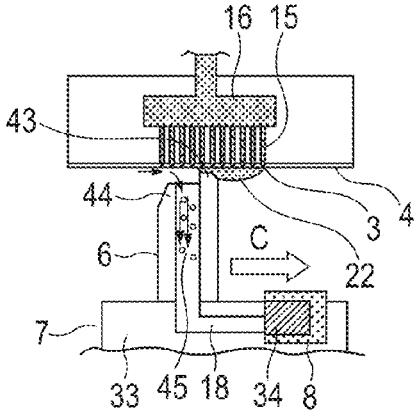
FIG. 24B is a view illustrating a state in which the suction port is on the way of moving along the discharge port surface.
Figure 24C:
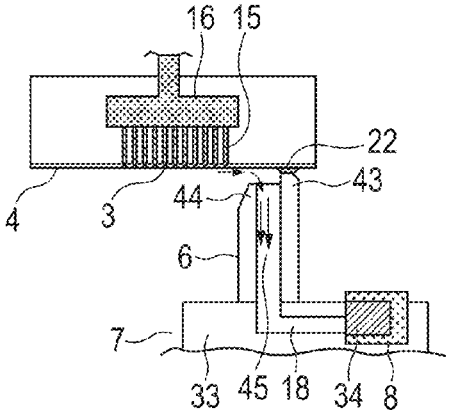
FIG. 24C is a view illustrating a state in which the suction port has moved to the outside of a region in which the discharge port is formed, from the inside of the region in which the discharge port is formed, on the discharge port surface.

FIG. 24A illustrates a state in which the liquid 22 has been supplied up to the surface of the discharge port surface 4 by the supply unit 5. FIG. 24B illustrates a state in which the suction port 6 is on the way of moving along the discharge port surface. FIG. 24C illustrates a state in which the suction port 6 has moved to the outside of a region in which the discharge port is formed, from the inside of the region in which the discharge port is formed, on the discharge port surface.

Specifically, the pump (unillustrated) is operated which is provided in the negative-pressure generation mechanism 34 in the controlling unit 8. Incidentally, the pressure which is generated by the pump is controlled to the negative pressure by using a regulator (unillustrated) and a pressure-detecting portion (unillustrated). Thereby, an air flow (tail wind effect) which flows from the rear opening 44 toward the liquid-collection opening 45 can be formed, in a state in which the discharge port surface 4 and the liquid-holding portion 43 come in contact with and hold the liquid 22 therebetween.

By being pushed by the air flow, the liquid 22 which is held in between the discharge port surface 4 and the liquid-holding portion 43 can easily move together with the moving unit 33 along the moving direction. Therefore, the liquid 22 on the discharge port surface 4 can be surely moved from the inside of a region in which the discharge port 3 is formed, to the outside of the region in which the discharge port is formed.

Here, a pressure of the inner part of the liquid-collection opening 45 is controlled, for instance, to −1 kPa by the negative-pressure generation mechanism 34. However, the pressure of the inner part of the liquid-collection opening 45 is not limited to the above described numeric value.

The pressure in the inside of the suction port 6 is controlled to −1 kPa while the suction port 6 is moving, and accordingly a part of the liquid 22 which the discharge port surface 4 and the liquid-holding portion 43 come in contact with and hold therebetween is sucked through the suction port 6 and is collected in an unillustrated liquid-storing portion in the controlling unit 8 through the suction flow channel 18. In addition, a part of the remainder of the liquid 22 on the discharge port surface 4 moves together with the moving unit 33 by the air flow (tailwind effect) that flows from the rear opening 44 toward the liquid-collection opening 45, in a state of being held in between the discharge port surface 4 and the liquid-holding portion 43.

The liquid discharge apparatus 1 has the liquid-holding portion 43 (first counter surface portion) and the rear opening 44 (second counter surface portion) provided in the end which faces the discharge port surface 4 of the suction port 6, controls the pressure of the inner part of the suction port 6 to a suitable pressure, and thereby can move the liquid 22 on the discharge port surface 4 according to the movement of the suction port 6, on the discharge port surface 4.

Thus, the liquid discharge apparatus 1 of the present embodiment includes: the head 2 having the discharge port surface 4 on which the discharge port 3 is provided for discharging the liquid; the negative pressure generating unit 7 which is arranged so as to surface the discharge port surface 4 and generates the negative pressure with respect to the discharge port surface 4; and the moving unit 33 which moves the negative pressure generating unit 7 along a predetermined direction.

In addition, the negative pressure generating unit 7 includes: the suction opening 45 which generates a negative pressure by suction; the first counter surface portion 43 which is arranged so as to be separated from the discharge port surface 4 at the first distance, on a more forward side along the predetermined direction than the suction opening 45; and the second counter surface portion 44 which is arranged so as to be separated from the discharge port surface 4 at the second distance that is longer than the first distance, on a more backward side along the predetermined direction than the suction opening 45. Furthermore, the liquid 22 is held in between the first counter surface portion 43 and the above described discharge port surface 4.

According to the liquid discharge apparatus of the present embodiment, the liquid moving unit 7 (negative pressure generating unit) moves the liquid-holding portion 43 along the discharge port surface 4, and thereby can move the liquid 22 on the discharge port surface 4 to the position in which the discharge port 3 is not provided.

In addition, the liquid 22 on the discharge port surface 4 is moved to the position in which the discharge port 3 is not provided, and accordingly the deposited substance such as the droplet and the foreign substance in the vicinity of the discharge port 3 is removed. Furthermore, the liquid moving unit 7 (negative pressure generating unit) is configured to be movable along the discharge port surface 4, accordingly the occurrence of unevenness is suppressed in the region on the discharge port surface 4, from which the deposited substance is removed, and such a possibility can be lowered that the deposited substance remains in the vicinity of the discharge port 3.

Eleventh Embodiment

Figure 25:
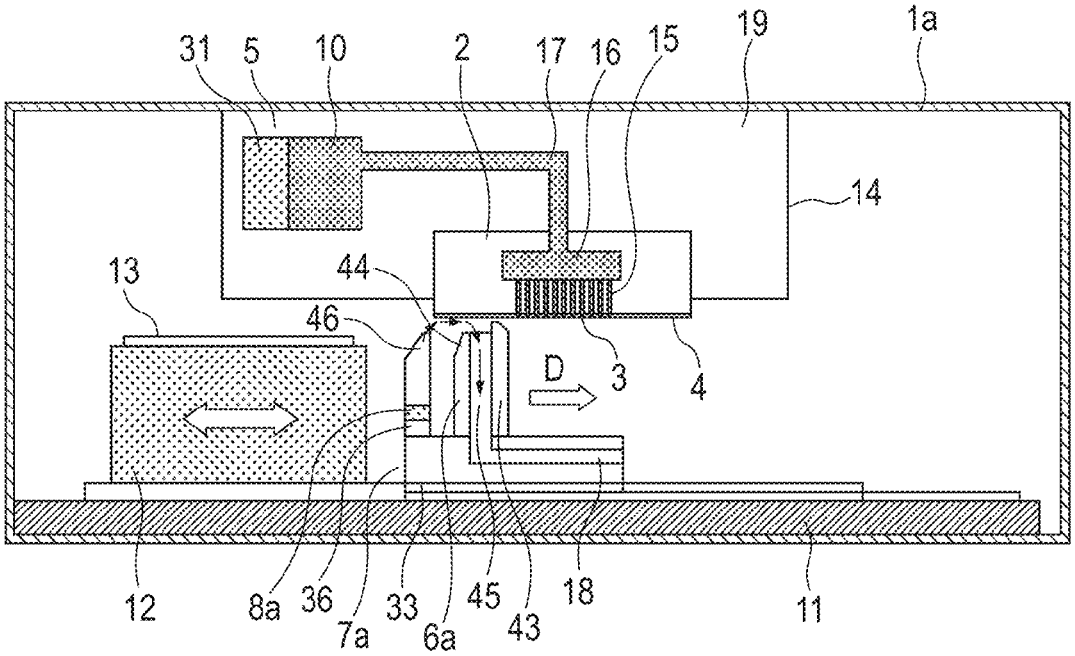
FIG. 25 is a cross-sectional view illustrating a configuration of a liquid discharge apparatus of an eleventh embodiment.

FIG. 25 is a cross-sectional view illustrating a configuration of a liquid discharge apparatus 1*a* of the present embodiment.

The liquid discharge apparatus 1*a* of the present embodiment is different from the liquid discharge apparatus 1 of the tenth embodiment, in the point that a nozzle 46 (nozzle portion) is provided as an implement of generating the air flow (tail wind) which flows from the rear opening 44 toward the liquid-collection opening 45. In addition, in the present embodiment, a drop collection port 6*a* basically has the same configuration as that of the suction port 6 of the tenth embodiment, but the controlling unit 8 for generating the negative pressure and the negative-pressure generation mechanism 34 are not provided. On the other hand, the nozzle 46 is provided with a controlling unit 8*a* and a positive pressure generating mechanism 36.

The nozzle 46 is provided in the moving section 33, and is arranged in a backward side of the moving direction (direction D) of the moving section 33 with respect to the drop collection port 6*a* (collection opening 45). In addition, the nozzle 46 is arranged so as to blow a wind onto the discharge port surface 4.

Hereafter, the movement state of the liquid 22 on the discharge port surface 4 by the liquid moving unit 7*a* (counter member) will be described with reference to FIG. 26A to FIG. 26C.

Figure 26A:
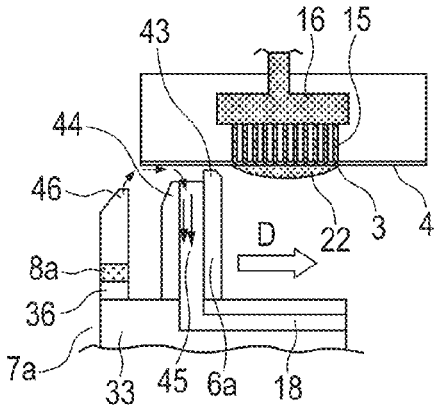
FIG. 26A is a view illustrating a state in which a liquid has been supplied up to the surface of a discharge port surface by a supply unit.

FIG. 26A illustrates a state in which the liquid 22 has been supplied up to the surface of the discharge port surface 4 by the supply unit 5. FIG. 26B illustrates a state in which the drop collection port 6*a* is on the way of moving along the discharge port surface. FIG. 26C illustrates a state in which the drop collection port 6*a* has moved to the outside of a region in which a discharge port is formed, from the inside of the region in which the discharge port is formed, on the discharge port surface.

Figure 26B:
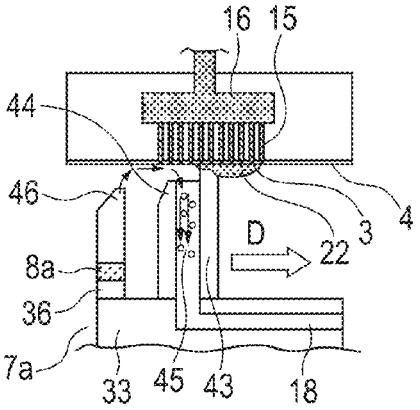
FIG. 26B is a view illustrating a state in which a drop collection port is on the way of moving along the discharge port surface.
Figure 26C:
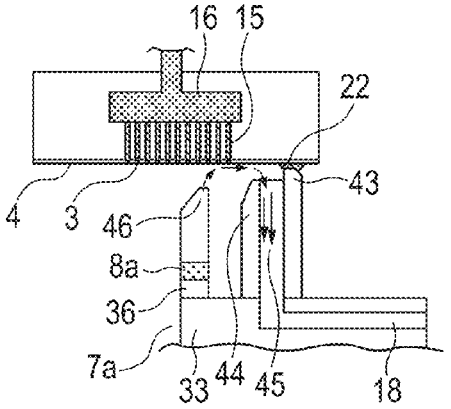
FIG. 26C is a view illustrating a state in which the drop collection port has moved to the outside of a region in which a discharge port is formed, from the inside of the region in which the discharge port is formed, on the discharge port surface.

As is illustrated in FIG. 26B, as the moving unit 33 is moved, the liquid 22 which is held in between the discharge port surface 4 and the liquid-holding portion 43 is moved along the moving direction D together with the moving section 33, by the air blown from the nozzle 46 (nozzle portion).

In addition, out of the liquid 22 on the discharge port surface 4, which has been collected along with the movement of the moving unit 33, a part of the liquid which has not been capable of being held in between the discharge port surface 4 and the liquid-holding portion 43 drops onto the drop collection port 6*a* and is collected in the unillustrated liquid-storing portion through the suction flow channel 18.

Incidentally, in the present embodiment, the nozzle 46 has been arranged in a position which is distant from the drop collection port 6*a*, but may be formed in the rear opening 44 (second counter surface). In addition, the distance between the nozzle 46 and the discharge port surface 4 can be set to be longer than that between the liquid-holding portion 43 (first counter surface) and the discharge port surface 4.

Thus, the liquid discharge apparatus 1*a* of the present embodiment includes: the head 2 having the discharge port surface 4 on which the discharge port 3 is provided for discharging the liquid; a counter member 7*a* which is arranged so as to surface the discharge port surface 4; and the moving unit 33 which moves the counter member 7*a* along a predetermined direction.

In addition, the counter member 7*a* includes: the collection opening 45 which collects the liquid on the discharge port surface 4; the first counter surface portion 43 which is arranged so as to be separated from the discharge port surface 4 at the first distance on a more forward side along the predetermined direction than the collection opening 45; the second counter surface portion (44) which is arranged so as to be separated from the discharge port surface 4 at the second distance that is longer than the first distance, on a more backward side along the predetermined direction than the collection opening 45; and the nozzle portion 46 which is arranged on a more backward side along the predetermined direction than the collection opening 45 and blows a gas to the discharge port surface 4.

According to the liquid discharge apparatus of the present embodiment, the liquid moving unit 7*a* (counter member) moves the liquid-holding portion 43 along the discharge port surface 4, and thereby can move the liquid 22 on the discharge port surface 4 to the position in which the discharge port 3 is not provided.

In addition, the liquid 22 on the discharge port surface 4 is moved to the position in which the discharge port 3 is not provided, and accordingly the deposited substance such as the droplet and the foreign substance in the vicinity of the discharge port 3 is removed. Furthermore, the liquid moving unit 7*a* (counter member) is configured to be movable along the discharge port surface 4, accordingly the occurrence of unevenness is suppressed in the region on the discharge port surface 4, from which the deposited substance is removed, and such a possibility can be lowered that the deposited substance remains in the vicinity of the discharge port 3.

Twelfth Embodiment

Figure 27:
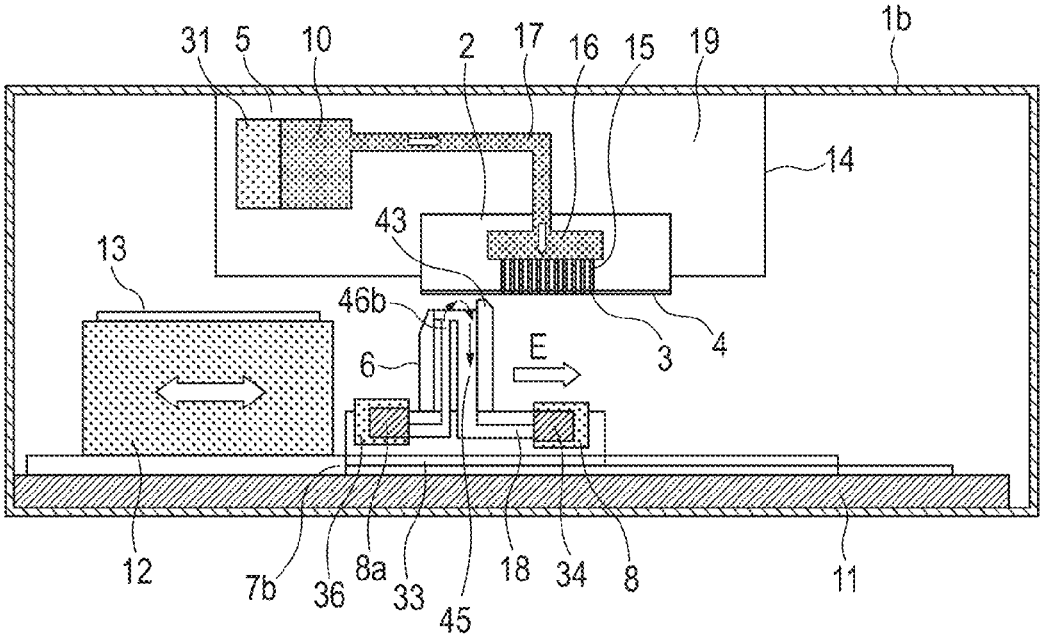
FIG. 27 is a cross-sectional view illustrating a configuration of a liquid discharge apparatus of a twelfth embodiment.

FIG. 27 is a cross-sectional view illustrating a configuration of a liquid discharge apparatus 1*b* of the present embodiment.

The liquid discharge apparatus 1*b* of the present embodiment has a configuration in which the liquid discharge apparatuses 1 and 1*a* of the tenth embodiment and the eleventh embodiment are united basically.

Specifically, in the present embodiment, a nozzle 46*b* (nozzle portion) is formed in a suction port 6 of a liquid moving unit 7*b* (negative pressure generating unit). On the other hand, the nozzle 46*b* is provided with a controlling unit 8*a* and a positive pressure generating mechanism 36. In addition, the suction flow channel 18 of the suction port 6 is provided with the controlling unit 8 and the negative-pressure generation mechanism 34.

In addition, the nozzle 46*b* is formed of a part formed after the inner part of the suction port 6 is divided by a partition portion. The nozzle 46*b* is arranged on a backward side of the moving direction (E) of the moving section 33 with respect to a liquid-holding portion 43. In addition, the nozzle 46 is arranged on a backward side of the moving direction (E) compared to a liquid-collection opening 45.

Hereafter, the movement state of the liquid 22 on the discharge port surface 4 by the liquid moving unit 7*b* (negative pressure generating unit) will be described with reference to FIG. 28A to FIG. 28C.

Figure 28A:
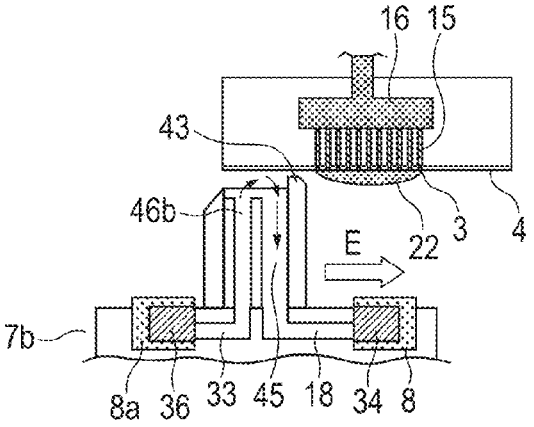
FIG. 28A is a view illustrating a state in which a liquid has been supplied up to the surface of a discharge port surface by a supply unit.

FIG. 28A is a view illustrating a state in which the liquid has been supplied up to the surface of the discharge port surface 4 by a supply unit 5. FIG. 28B is a view illustrating a state in which the moving section 33 is on the way of moving in the direction (moving direction) shown by the arrow E. FIG. 28C is a view illustrating a state in which the liquid 22 on the discharge port surface 4 has moved to a position in which the discharge port 3 is not provided.

Figure 28B:
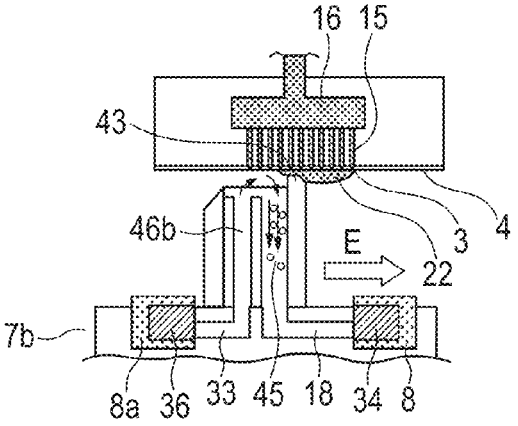
FIG. 28B is a view illustrating a state in which a moving section is on the way of moving in the direction of the arrow E.
Figure 28C:
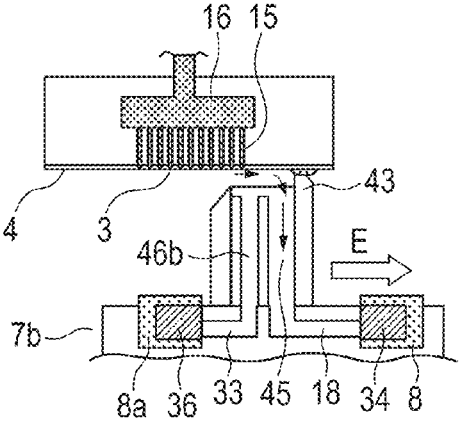
FIG. 28C is a view illustrating a state in which a liquid on the discharge port surface has moved to the outside of a region in which a discharge port is formed, from the inside of the region in which the discharge port is formed, on the discharge port surface.

As is illustrated in FIG. 28B, as the moving unit 33 is moved, the liquid 22 which is held in between the discharge port surface 4 and the liquid-holding portion 43 is moved along the direction E together with the moving section 33, by the air blown from the nozzle 46*b* (nozzle portion). Incidentally, out of the liquid 22 on the discharge port surface 4, which has been collected along with the movement of the moving unit 33, a part of the liquid which has not been capable of being held in between the discharge port surface 4 and the liquid-holding portion 43 is sucked from the liquid-collection opening 45, and is collected in an unillustrated liquid-storing portion in the controlling unit 8 through the suction flow channel 18.

The effect similar to each of the above described embodiments can be obtained from the present embodiment.

According to the present invention, the liquid on the discharge port surface is moved to a collection position in which the discharge port is not provided, by the liquid moving unit, and accordingly the deposited substance such as the droplet and the foreign substance in the vicinity of the discharge port is removed. In addition, the liquid moving unit is configured to be movable along the discharge port surface, accordingly the occurrence of unevenness is suppressed in the region on the discharge port surface, from which the deposited substance is removed, and such a possibility is lowered that the deposited substance remains in the vicinity of the discharge port.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-241625, filed Nov. 22, 2013, and No. 2014-210225, filed Oct. 14, 2014 which are hereby incorporated by reference herein in their entirety.

What is claimed is:

1. A liquid discharge apparatus comprising:

a head having a discharge port surface on which a discharge port is provided for discharging a liquid;

a suction port arranged apart from the discharge port surface and configured to be movable along the discharge port surface;

a negative pressure generating unit configured to communicate with the suction port and generate a negative pressure; and an elevating unit for changing a distance between the suction port and the discharge port surface, wherein, upon the movement of the suction port, the liquid on the discharge port surface is moved to a collection position at which the discharge port is not provided by suction from the suction port with the negative pressure generated by the negative pressure generating unit, and then the liquid is collected by the suction from the suction port, and wherein a distance between the suction port and the discharge port surface is set by the elevating unit to be less in an operation of collecting a liquid that has been moved to the collection position than in an operation of moving the liquid to the collection position.

2. The liquid discharge apparatus according to claim 1, further comprising:

a liquid-holding portion arranged apart from the discharge port surface and configured to hold a liquid in between the liquid-holding portion and the discharge port surface.

3. The liquid discharge apparatus according to claim 1, further comprising:

a collection suction port which is able to communicate with the negative pressure generating unit, and which has an opening area smaller than that of the suction port, wherein, the liquid on the discharge port surface is moved to the collection position by the suction from the suction port in a state that the negative pressure generating unit is communicated with the suction port, and the liquid is then sucked through the collection suction port in a state that the negative pressure generating unit is communicated with the collection suction port.

4. The liquid discharge apparatus according to claim 1, further comprising:

a liquid collection unit provided in the collection position and configured to collect a liquid in the vicinity of the collection position.

5. The liquid discharge apparatus according to claim 4, wherein the liquid collecting unit is provided with a liquid collecting port and sucks the liquid from the liquid collecting port.

6. The liquid discharge apparatus according to claim 1, further comprising:

a moving section for moving the suction port, wherein the suction port moves along the discharge port surface in accordance with a movement of the moving section.

7. The liquid discharge apparatus according to claim 1, wherein the suction port has a shape of one of an oval, an elliptical shape, a circle, a square, and a rectangle.

8. The liquid discharge apparatus according to claim 1, wherein a portion of the liquid is sucked through the suction port and collected when the liquid on the discharge port surface is moved to the collection position through the suction port.

9. The liquid discharge apparatus according to claim 1, wherein a pressure in the head when the liquid on the discharge port surface is moved to the collection position by the suction port is higher than the pressure in the head when the liquid being moved to the collection position is collected by the suction port.

10. The liquid discharge apparatus according to claim 1, further comprising:

a head guide portion for guiding the head, wherein the head guide portion is provided with one surface which is substantially on the same plane as the discharge port, and the collection position is provided on the one surface.

11. The liquid discharge apparatus according to claim 1, wherein a distance between the discharge port and the suction port is a distance in which the liquid on the discharge port surface is contactable with the suction port.

12. A liquid discharge apparatus comprising:

a head having a discharge port surface on which a discharge port is provided for discharging a liquid;

a nozzle arranged apart from the discharge port surface and configured to be movable along the discharge port surface; and a positive pressure generating unit configured to communicate with the nozzle and to generate a positive pressure, wherein the liquid on the discharge port surface is moved to a collection position at which the discharge port is not provided, by moving the nozzle and blowing air from the nozzle with the positive pressure generated by the positive pressure generating unit.

13. The liquid discharge apparatus according to claim 4, wherein the liquid collecting unit comprises a liquid-collecting body configured to absorb the liquid by a capillary force.

14. The liquid discharge apparatus according to claim 13, wherein the liquid-collecting body is impregnated with a nonvolatile liquid or a liquid having water retentivity.

15. The liquid discharge apparatus according to claim 13, wherein the liquid collecting unit has a suction ventilation tube for sucking a liquid collected by the liquid-collecting body.

16. The liquid discharge apparatus according to claim 4, further comprising:

a lyophilic treatment portion having lyophilic properties, which is provided in the periphery of the liquid collecting unit.

17. The liquid discharge apparatus according to claim 1, further comprising:

a liquid-repellent treatment portion having liquid repellency, which is provided in the periphery of the discharge port.

18. The liquid discharge apparatus according to claim 1, further comprising:

a supply unit for supplying the liquid to the head, wherein the supply unit applies a first positive pressure to the liquid for supplying the liquid to the head, and then the supply unit applies a second positive pressure to the liquid, in which an absolute value of the second positive pressure is smaller than that of the first positive pressure.

19. A method for controlling a liquid discharge apparatus including a head having a discharge port surface on which a discharge port is provided for discharging a liquid, comprising:

a suction port arranged apart from the discharge port surface and configured to be movable along the discharge port surface;

a negative pressure generating unit configured to communicate with the suction port and generate a negative pressure; and an elevating unit for changing a distance between the suction port and the discharge port surface, the method comprising:

moving the suction port along the discharge port surface, in a state that a distance between the suction port and the discharge port surface is set to a first distance by the elevating unit, so as to move a liquid on the discharge port surface to a collection position at which the discharge port is not provided with suction through the suction port caused by a negative pressure generated by the negative pressure generating unit, and sucking through the suction port so as to collect the liquid which has been moved to the collection position in a state that a distance between the suction port and the discharge port surface is set by the elevating unit to a second distance which is smaller than the first distance.

20. A liquid discharge apparatus comprising:

a head having a discharge port surface on which a discharge port is provided for discharging a liquid;

a suction port arranged apart from the discharge port surface and configured to be movable along the discharge port surface;

a negative pressure generating unit configured to communicate with the suction port and generate a negative pressure;

an elevating unit for changing a distance between the suction port and the discharge port surface;

a first control unit for causing the suction port to perform a movement along the discharge port surface, in a state that a distance between the suction port and the discharge port surface is set to a first distance by the elevating unit, so as to move a liquid on the discharge port surface to a collection position at which the discharge port is not provided with a suction through the suction port caused by a negative pressure generated by the negative pressure generating unit, and a second control unit for causing the suction port to perform a collection to collect the liquid which has been moved to the collection position by sucking through the suction port in a state that a distance between the suction port and the discharge port surface is set by the elevating unit to a second distance which is smaller than the first distance.

21. The liquid discharge apparatus according to claim 20, further comprising:

a moving section for moving the suction port, wherein the suction port moves along the discharge port surface in accordance with a movement of the moving section.

22. The liquid discharge apparatus according to claim 20, wherein the suction port has a shape of one of an oval, an elliptical shape, a circle, a square, and a rectangle.

23. The liquid discharge apparatus according to claim 20, wherein a portion of the liquid is sucked through the suction port and collected when the movement of the suction port is performed.

24. The liquid discharge apparatus according to claim 20, wherein a pressure in the head when the movement of the suction port is performed is higher than the pressure in the head when the collection of the liquid is performed.

25. The liquid discharge apparatus according to claim 20, further comprising:

a head guide portion for guiding the head, wherein the head guide portion is provided with one surface which is substantially on the same plane as the discharge port, and the collection position is provided on the one surface.

26. The liquid discharge apparatus according to claim 20, wherein a distance between the discharge port and the suction port is a distance in which the liquid on the discharge port surface is contactable with the suction port.

27. The liquid discharge apparatus according to claim 20, further comprising:

a liquid-holding portion arranged apart from the discharge port surface and configured to hold a liquid in between the liquid-holding portion and the discharge port surface.

28. The liquid discharge apparatus according to claim 20, further comprising:

a collection suction port which is able to communicate with the negative pressure generating unit, and which has an opening area smaller than that of the suction port, wherein, the liquid on the discharge port surface is moved to the collection position by the suction from the suction port in a state that the negative pressure generating unit is communicated with the suction port, and then the liquid is sucked through the collection suction port in a state that the negative pressure generating unit is communicated with the collection suction port.

29. The liquid discharge apparatus according to claim 20, further comprising:

a liquid collection unit provided in the collection position and configured to collect a liquid in the vicinity of the collection position.

30. The liquid discharge apparatus according to claim 29, wherein the liquid collection unit is provided with a liquid collection port and sucks the liquid from the liquid collection port.

* * * * *